US008931618B2

(12) United States Patent
Walsh et al.

(10) Patent No.: US 8,931,618 B2
(45) Date of Patent: Jan. 13, 2015

(54) SMALL AND BULK PACK NAPKIN SEPARATOR

(75) Inventors: James Andrew Walsh, Ashland, WI (US); James R. Michler, Ashland, WI (US); Tim Schramm, Ashland, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 173 days.

(21) Appl. No.: 13/362,116

(22) Filed: Jan. 31, 2012

(65) Prior Publication Data

US 2012/0201643 A1 Aug. 9, 2012

Related U.S. Application Data

(60) Provisional application No. 61/440,767, filed on Feb. 8, 2011.

(51) Int. Cl.

| | |
|---|---|
| ***B65H 31/30*** | (2006.01) |
| ***B65H 33/14*** | (2006.01) |
| ***B65H 33/16*** | (2006.01) |

(52) U.S. Cl.

CPC ..... *B65H 31/309* (2013.01); *B65H 31/3081* (2013.01); *B65H 33/14* (2013.01); *B65H 33/16* (2013.01); *B65H 2301/33214* (2013.01); *B65H 2301/33222* (2013.01); *B65H 2301/422* (2013.01); *B65H 2301/448* (2013.01); *B65H 2511/152* (2013.01); *B65H 2513/42* (2013.01); *B65H 2701/1924* (2013.01); *B65H 2404/6111* (2013.01); *B65H 2404/691* (2013.01)

USPC ..... 198/370.08; 270/39.02

(58) Field of Classification Search

USPC ..... 198/368, 370.01, 370.08, 370.09, 198/370.1, 429, 436, 440, 441, 442, 456, 198/457.01, 457.05, 468.1, 479.1, 480.1, 198/774.1; 209/653, 654; 270/32, 39.01, 270/39.02, 39.05; 271/298, 303, 305; 414/788, 789.2, 789.9, 790, 790.2, 414/790.3, 790.4, 790.6, 790.9, 794.9, 795, 414/796, 796.1; 493/356, 357, 362, 454; 53/446, 447, 540, 542, 544

See application file for complete search history.

(56) References Cited

U.S. PATENT DOCUMENTS

| | | | | |
|---|---|---|---|---|
| 2,675,747 | A | 4/1954 | Greiner et al. | |
| 2,761,677 | A | 9/1956 | Rutkus et al. | |
| 3,207,361 | A | 9/1965 | Marcalus | |
| 3,236,162 | A * | 2/1966 | Reist | 198/419.3 |

(Continued)

FOREIGN PATENT DOCUMENTS

| | | |
|---|---|---|
| EP | 0654408 A1 | 5/1995 |
| GB | 2134891 A | 8/1984 |

*Primary Examiner* — Gregory Adams

(74) *Attorney, Agent, or Firm* — Reinhart Boerner Van Deuren P.C.

(57) ABSTRACT

An apparatus and method are provided, for alternatively producing either small or bulk packs of napkins from a stack of folded napkins produced by one folding machine, through use of a pack dispatching arrangement having an inlet, a small pack transfer station and a bulk pack transfer station, and configured for operation in a small pack mode for dispatching a stream of spaced apart small packs of folded sheets separated from the stack of folded sheets, and received at an inlet of the pack dispatching arrangement, to the small pack transfer station, and alternatively operable in a bulk pack mode for dispatching a stream of spaced apart bulk packs of folded sheets separated from the stack of folded sheets, and received at an inlet of the pack dispatching arrangement, to the bulk pack transfer station.

18 Claims, 32 Drawing Sheets

(56) References Cited

U.S. PATENT DOCUMENTS

| | | | | | |
|---|---|---|---|---|---|
| 4,141,193 | A | | 2/1979 | Joa | |
| 4,483,124 | A | * | 11/1984 | Ohba et al. | 53/54 |
| 4,494,741 | A | | 1/1985 | Fischer et al. | |
| 4,700,939 | A | | 10/1987 | Hathaway | |
| 4,717,135 | A | | 1/1988 | Hathaway | |
| 4,721,295 | A | | 1/1988 | Hathaway | |
| 4,770,402 | A | | 9/1988 | Couturier | |
| 4,824,426 | A | | 4/1989 | DuFresne | |
| 4,874,158 | A | | 10/1989 | Retzloff | |
| 4,884,677 | A | * | 12/1989 | Yu et al. | 198/370.02 |
| 4,917,365 | A | | 4/1990 | Stemmler et al. | |
| 4,938,465 | A | | 7/1990 | Marsiletti | |
| 5,040,663 | A | | 8/1991 | Gould et al. | |
| 5,088,707 | A | | 2/1992 | Stemmler | |
| 5,299,793 | A | | 4/1994 | Couturier | |
| 5,597,285 | A | | 1/1997 | Meyer et al. | |
| 5,692,877 | A | * | 12/1997 | Sixtensson | 414/791.1 |
| 5,730,695 | A | | 3/1998 | Hauschild et al. | |
| 5,733,099 | A | * | 3/1998 | Honneger | 414/788 |
| 6,165,116 | A | | 12/2000 | White | |
| 6,189,702 | B1 | * | 2/2001 | Bonnet | 209/651 |
| 6,279,750 | B1 | * | 8/2001 | Lohmann | 209/559 |
| 6,322,315 | B1 | | 11/2001 | Schmidt et al. | |
| 6,641,358 | B2 | | 11/2003 | Schmidt et al. | |
| 6,712,746 | B1 | | 3/2004 | White | |
| 7,080,740 | B2 | * | 7/2006 | Uchikura | 209/651 |
| 7,185,751 | B2 | * | 3/2007 | Guidetti | 198/418.6 |
| 7,470,102 | B2 | | 12/2008 | Gendron et al. | |
| 2002/0079253 | A1 | * | 6/2002 | Lem et al. | 209/586 |
| 2002/0179502 | A1 | * | 12/2002 | Cerutti et al. | 209/583 |
| 2004/0222584 | A1 | * | 11/2004 | Krieger et al. | 270/32 |
| 2009/0298661 | A1 | | 12/2009 | Grill | |
| 2011/0255946 | A1 | | 10/2011 | Walsh | |
| 2011/0268551 | A1 | * | 11/2011 | Kokubo et al. | 414/796 |

* cited by examiner

FIG. 12T
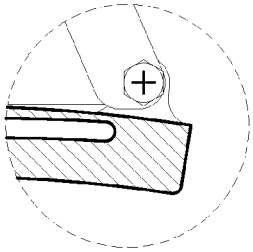
FIG. 12S
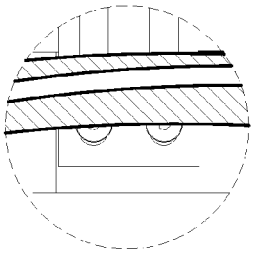
FIG. 12R
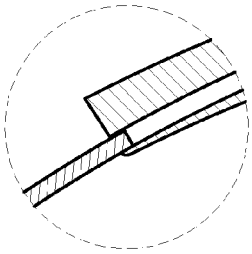
FIG. 12Q
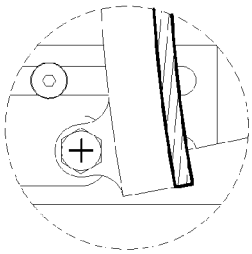
FIG. 12P
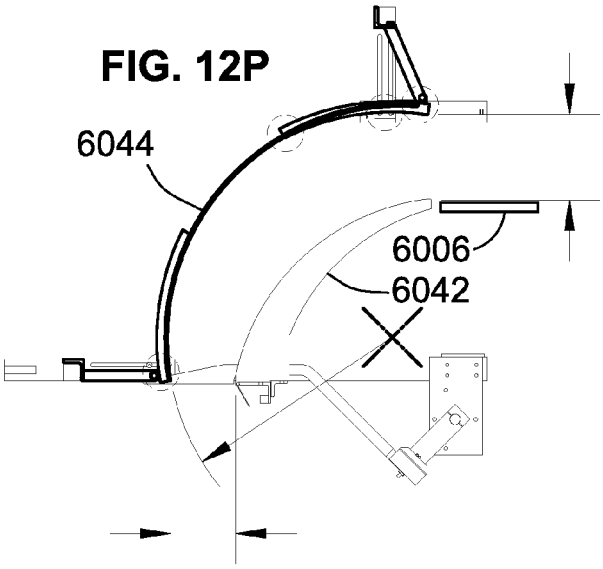
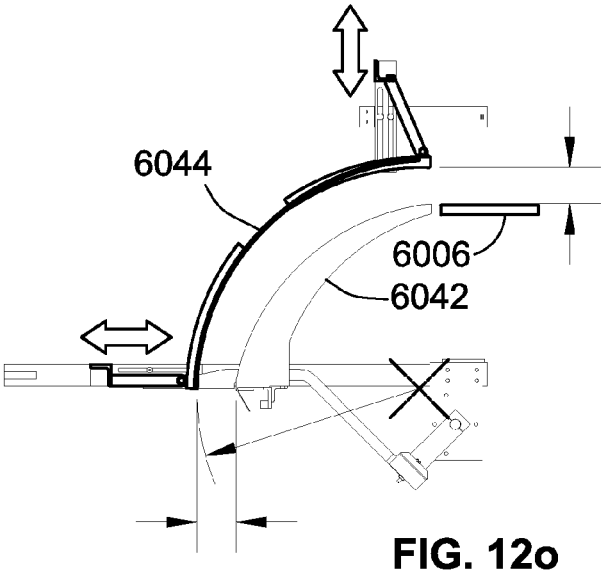
FIG. 12o

SMALL AND BULK PACK NAPKIN SEPARATOR

CROSS-REFERENCE TO RELATED PATENT APPLICATIONS

This patent application claims the benefit of U.S. Provisional Patent Application No. 61/440,767, filed Feb. 8, 2011, the entire teachings and disclosure of which are incorporated herein by reference thereto.

FIELD OF THE INVENTION

This invention relates to the production of bulk packs and small packs of napkins and the like from a stack of folded sheets, and more particularly to an apparatus and method for separating a continuously building stack of sheets into a series of bulk packs or alternatively into a series of small packs.

BACKGROUND OF THE INVENTION

Napkins are typically packaged for sale in either a so-called "small pack" or a "bulk pack." The napkins in the bulk packs are typically compressed prior to being wrapped in a poly film or paper wrapper, and are shipped in the compressed state. Small packs are typically not compressed prior to wrapping. The napkins within a bulk pack or a small pack may be interfolded, in some products and simply folded one or more times without interfolding in other products.

The production of either bulk packs or small packs (also referred to as "flat packs") of napkins involves essentially three separate processes. In the first process the napkins are folded. Typically a folding apparatus will produce a continuously building stack of folded or interfolded napkins In the second step in the process, the stack is separated into a stream of spaced-apart packs of napkins In the third step of the process, the napkins are wrapped. The machinery associated with such processes is generally referred to as a folder, a separator, and a wrapper.

The machinery and processes previously utilized for producing bulk packs of napkins were incapable of producing small packs. Similarly, prior approaches and machinery for making small packs were incapable of producing bulk packs.

In prior methods and apparatuses for producing bulk packs, the folded sheets generally proceed through the entire machine with the napkins standing on edge, with the individual bulk packs being compressed by a portion of the separator or the wrapper, prior to the wrapping material being secured about the compressed bulk pack. Commonly assigned U.S. Pat. No. 7,470,102 illustrates such an apparatus and method.

In prior small pack production methods and machinery, however, the small packs are typically processed with the napkins lying flat, and being moved along from one process station to another by a continuously moving paddle conveyor. Commonly assigned U.S. Pat. No. 6,832,886 illustrates such a prior approach and apparatus.

It is desirable to provide a new apparatus and method capable of alternatively producing either bulk packs or small packs of napkins on a single processing line.

BRIEF SUMMARY OF THE INVENTION

The invention provides an improved apparatus and method for producing either small or bulk packs in a single processing line through use of a pack dispatching arrangement operable in a bulk pack mode for delivering bulk packs received at an inlet of the pack dispatching arrangements to a bulk pack transfer station with the sheets in the bulk pack resting on the edges of the folded sheets, and also alternatively operable in a small pack mode for delivering small packs received at the inlet of the pack dispatching arrangement to a small pack transfer station with the small pack resting on one of the faces of the small pack.

In one form of the invention, a pack dispatching arrangement is provided for alternatively dispatching a stream of spaced apart small packs or bulk packs of folded sheets separated from a stack of folded sheets by a single separator arrangement along different paths, such as paths to different wrappers for different sized packs. The separator arrangement separates the stack of folded sheets into a stream of spaced apart packs of folded sheets, with the folded sheets in the stack in the separated packs being oriented on an edge of the folded sheets. The packs each have an upstream and downstream face thereof oriented substantially perpendicular to the edges of the folded sheets. The pack dispatching arrangement includes an inlet for receiving each pack from the separator arrangement with the sheets in the pack oriented on their edges. The pack dispatching arrangement further includes a bulk pack transfer station and a small pack transfer station. The bulk pack dispatching arrangement is operable in a bulk pack mode for delivering a bulk pack received at the inlet of the pack dispatching arrangement to the bulk pack transfer station with the sheets in the bulk pack resting on the edges of the folded sheets. The pack dispatching arrangement is alternatively operable in a small pack mode for delivering a small pack received at the inlet of the pack dispatching arrangement to the small pack transfer station with the small pack resting on one of the faces of the small pack.

Some forms of a pack dispatching arrangement, according to the invention, include a pack turning arrangement having a pack directing surface for contacting the edges of the sheets in each small pack, during operation of the pack dispatching arrangement in the small pack mode. The pack directing surface urges the small pack to turn from the orientation as received at the inlet, with the sheets in the pack oriented on the edges of the sheets, toward the orientation with the small pack resting on one of the faces of the small pack.

Where a single separator arrangement produces first and second parallel streams of spaced apart small packs or bulk packs of folded sheets separated from respective first and second stacks of folded sheets, a pack dispatching arrangement according to the invention may include first and second dispatching channels and a control arrangement operatively connected between the single separator and the first and second dispatching channels. Each of the first and second dispatching channels include respective inlets, bulk pack transfer stations, small pack transfer stations, and pack turning arrangements. The control arrangement is operatively connected for alternatively controlling operation of the separator arrangement in respective first and second dispatching channels in the bulk pack and small pack modes of operation.

In some forms of the invention having first and second dispatching channels within a pack dispatching arrangement according to the invention, the first and second inlets and their respective transfer stations are aligned in a parallel relationship with one another along a common first plane. The small pack transfer stations are aligned with one another in a parallel arrangement along a second common plane offset from and extending substantially parallel to the first common plane. The control arrangement operates the first and second pack turning arrangements for delivering small packs received at the respective first and second inlets to the respective first and second small pack transfer stations with each of the small packs resting on one of the faces of that small pack in the small pack mode.

In some forms of the invention, the control arrangement in a pack dispatching arrangement, according to the invention, is configured to operate the first and second pack turners independently from one another. The control arrangement may be further configured for operating the first and second pack turners in such a manner that delivery of one of the small packs in the first and second dispatching channels is delivered to its respective small pack transfer station later than the other of the small packs from the first and second dispatching channels.

A pack dispatching arrangement, according to the invention, may further include a small pack conveying arrangement disposed and operatively connected for receiving the small packs at the first and second small pack transfer stations and conveying the small packs away from the first and second small pack transfer stations. Such a pack conveying arrangement may include a moveable member passing sequentially through the first and second small pack transfer stations for receiving the small packs at the first and second small pack transfer stations and conveying the small packs away from the first and second small pack transfer stations.

A small pack conveying arrangement, according to the invention, may include a paddle conveyor having first and second moveable members in the form of spaced first and second paddles passing sequentially through the first and second small pack transfer stations for receiving the small packs at the first and second small pack transfer stations and conveying the small packs away from the first and second small pack transfer stations. The control arrangement may be operatively connected to the paddle conveyor and configured for operating the first and second pack turners in such a manner that delivery of one of the small packs in the first and second dispatching channels is delivered to its small pack transfer station later than the other of the small packs from the first and second dispatching channels, to thereby facilitate transfer of the small packs from the pack turners to the first and second paddles of the paddle conveyor. In some forms of the invention, the paddle conveyor of the small pack conveying arrangement may be configured for moving the first and second paddles through the first and second small pack transfer stations in the uniformly spaced manner at a constant speed.

In some forms of the invention, a separator apparatus is provided, for separating a stack of folded sheets into either small or bulk packs of folded sheets. Such a separator apparatus includes a separator arrangement and a pack dispatching arrangement. The separator arrangement is configured for separating the stack of folded sheets into a stream of spaced apart packs of folded sheets, in which the folded sheets in the stack and the separated packs are oriented on an edge of the folded sheets with the packs each having an upstream and a downstream face thereof oriented substantially perpendicular to the edges of the folded sheets. The separator arrangement is alternatively operable in a small pack and a bulk pack mode.

The pack dispatching arrangement includes an inlet for receiving each pack from the separator arrangement, with the sheets in the pack oriented on their edges. The pack dispatching arrangement also includes a bulk pack transfer station and a small pack transfer station. The pack dispatching arrangement is operable in a bulk pack mode for delivering a bulk pack received at the inlet of the pack dispatching arrangement to the bulk pack transfer station with the sheets in the bulk pack resting on the edges of the sheets. The pack dispatching arrangement is alternatively operable in a small pack mode for delivering a small pack received at the inlet to the small pack transfer station with the small pack resting on one of the faces of the small pack.

It will be noted that in either the bulk pack mode or the small pack mode of operation, the pack dispatching arrangement receives the bulk or small pack at the inlet of the pack dispatching arrangement with the sheets in the pack oriented on their edges. The pack dispatching arrangement then directs bulk packs to the bulk pack transfer station with the sheets in the pack still oriented on their edges in the bulk pack mode of operation. In the small pack mode of operation, the pack dispatching arrangement directs the small packs to the small pack transfer station and reorients the small packs in such a manner that they are delivered to the small pack transfer station with the sheets in each small pack resting on one of the faces of that respective small pack.

In this manner, a separator apparatus according to the invention may receive a continuous stream of folded sheets with the sheets resting on their edges, separate the sheets into small packs in the small pack or bulk packs in the bulk pack mode, with the pack dispatching arrangement delivering the stream of bulk packs to the bulk pack transfer station in the bulk pack mode, or alternatively delivering the small packs to the small pack transfer station in the small pack mode of operation. The bulk packs may then be delivered from the bulk pack transfer station to a bulk pack wrapper located downstream from the separator apparatus, or alternatively, in the small pack mode of operation, the small packs may be delivered from the small pack transfer region to a small pack wrapper located downstream from the pack dispatching arrangement. In the manner, the dispatching arrangement allows a single folder and separator to feed bulk packs and small packs to either a bulk pack wrapper or a small pack wrapper disposed downstream from the pack dispatching arrangement.

In an apparatus or method according to the invention, a pack dispatching arrangement may further include a pack turning arrangement having a pack directing surface for contacting the edges of the sheets in each small pack during operation of the pack dispatching arrangement in the small pack mode. The pack directing surface is configured for urging the small pack to turn from the orientation as received at the inlet of the pack turning arrangement, with the sheets in the pack oriented on the edges of the sheets, toward the orientation with the small pack resting on one of the faces of the small pack.

One form of a pack turning arrangement, according to the invention, includes a pivotable arm and at least one pack face guide member. The pivotable arm has a proximal end thereof pivotably attached with respect to the inlet of the pack dispatching arrangement. The pivotable arm includes the pack directing surface. The at least one pack face guide member is disposed adjacent the pivotable arm for contacting and supporting the one of the faces of the small pack, as the small pack is turned from resting on edge to resting on one of the faces of the small pack by the pack directing surface of the pivotable arm.

Where the small pack defines a length thereof between the upstream and downstream faces of the small pack, a pack turning arrangement having a pivotable arm, according to the invention, may further include upstream and downstream face guide members, spaced from one another in a parallel manner at a guide width for accommodating the small pack length. The upstream and downstream face guide members are configured for contacting and supporting both the upstream and downstream faces of the small pack as the small pack is turned from resting on edge to resting on one of the faces of the small pack. In some forms of the invention, at least one of the upstream and downstream guide members is moveable between at least a first and a second position thereof with respect to the inlet for changing the guide width between the upstream and downstream guide members to correspond with small packs having a first length and a second length different from the first length.

In some forms of the invention, the upstream and downstream guide members are at least partly curved and define respective longitudinal lengths thereof. At least one of the upstream and downstream guide members includes at least a first and a second element adjustably connected to one another for changing the longitudinal length of the at least one of the upstream and downstream guide members.

In forms of the invention having a separator arrangement, the separator arrangement includes an upstream finger and a downstream finger configured for respectively supporting the upstream and downstream faces of the small pack as it moves through the pack dispatching arrangement. The separator fingers are operatively connected for retracting after the small pack is moved into the upstream and downstream guide members by the pack directing surface of the pivotable arm. The separator fingers may then be operatively returned to a location for receiving a next small pack after retracting. Once in that location, one or both of the separator fingers can be extended and used to support the upstream and downstream faces of the next small pack.

In some forms of the invention having a pivotable arm, the pivotable arm is configured for receiving the small pack in a first angular position thereof with respect to the inlet and delivers the small pack to the small pack transfer station in a second angular position of the pivotable arm. The pivotable arm is also configured for returning to the first angular position thereof after delivering the small pack to the small pack transfer station for receiving a next small pack from the separator fingers.

In some forms of the invention having a pack dispatching arrangement including a pivotable arm, the pivotable arm remains in the second angular position thereof when the pack dispatching arrangement is operating in the bulk pack mode, and the separator fingers transport the bulk pack past the pivotable arm to the bulk pack transfer station.

Some forms of the invention do not use a pack dispatching arrangement having a pivotable arm.

In some forms of the invention, a pack turning arrangement, according to the invention, includes a rotatable pack turner.

In some forms of the invention, the rotatable pack turner rotates in only one direction about its axis of rotation.

In a further form of the invention, the small pack defines a width thereof between the edge resting on the pack directing surface of the rotatable pack turner and an opposite edge of the small pack that is spaced away from the pack directing surface, The rotatable pack turner may further include an opposite edge guide member extending from a distal end of the face guide surface. The opposite edge guide is spaced from the pack directing surface a sufficient distance for accommodating the small pack width. For instance, the spacing between the pack directing surface and the opposite edge guide may be slightly greater than the small pack width to accommodate variations in sheet size as well as variations in the uniformity of the width of the small pack. The opposite edge guide member may be configured for contacting and/or supporting the opposite edges of the small pack as the small pack is turned from resting on edge to resting on the downstream face of the small pack.

Some forms of the invention having a rotatable pack turner may also include an air nozzle operatively connected and configured for directing a jet of air against the upstream face of the small pack. The biasing or urging provided by the jet of air prevents upstream (or otherwise unsupported) sheets of the small pack from lifting off of the small pack while rotating from the inlet to the small pack transfer station.

In some forms of the invention, a separator arrangement may include an upstream finger and a downstream finger configured for respectively supporting the upstream and downstream faces of the small pack as it moves through the pack dispatching arrangement. The separator fingers may be operatively connected for retracting after the small pack is moved into a receptacle in the rotatable pack turner.

An air nozzle may be operatively connected and configured for directing a jet of air against the upstream face of the small pack for urging the small pack into the receptacle in the rotatable pack turner, to thereby urge the small pack to remain in the receptacle after the separator fingers are retracted. The separator fingers may be operatively connected for returning to receive another small pack subsequent to retracting after the small pack is moved from the separator fingers into the receptacle in the rotatable pack turner.

In forms of the invention having a rotatable pack turner, the rotatable pack turner may be configured for receiving the small pack in a first angular position thereof, with respect to the inlet and the rotational axis of the rotatable pack turner, and for delivering the small pack to the small pack transfer station in a second angular position of the rotatable pack turner with respect to the inlet and the rotational axis. The rotatable pack turner may be configured for returning to the first angular position thereof after delivering the small pack to the small pack transfer station for receiving a next small pack from the separator fingers. In some forms of the invention, the rotatable pack turner may rotate in only one direction about its axis of rotation while moving between the first and second angular positions of the rotatable pack turner.

Some forms of a rotatable pack turner, according to the invention, have at least two receptacles therein for receiving successive small packs from the separator fingers. The rotatable pack turner is further configured for receiving the small pack when the receptacles are respectively disposed in a first angular position thereof with respect to the inlet and rotational axes of the rotatable pack turner, and for delivering the small packs to the small pack transfer station when the receptacles are respectively disposed in a second angular position of the rotatable pack turner with respect to the inlet and the rotational axis. The rotatable pack turner may be further configured for successively returning the receptacles to the first angular position after delivering the small packs to the small pack transfer station, so that the receptacles may respectively receive.

Forms of the invention having a rotatable pack turner with at least two receptacles may also include an air nozzle operatively connected and configured for directing a jet of air against the upstream face of a small pack. The biasing or urging provided by the jet of air prevents upstream (or otherwise unsupported) sheets of the small pack from lifting off of the small pack while rotating from the inlet to the small pack transfer station. A rotatable pack turner having multiple receptacles may be rotatable in only one direction about its axis of rotation, in some forms of the invention.

In some forms, the rotatable pack turner may have two or more receptacles with each receptacle further including an opposite edge guide member. Such an opposite edge guide member may extend from a distal end of the face guide surface of each receptacle and be spaced from the pack directing surface of that respective receptacle for accommodating the small pack width as discussed above. The opposite edge guide member may be configured for contacting and/or supporting the opposite edge of the small pack as the small pack is turned from resting on edge to resting on the downstream face of the small pack.

In some forms of the invention, a rotatable pack turner includes four receptacles and has a cross-sectional shape perpendicular to the rotational axis of a wheel or disk with four equally spaced outward facing slots. The slots form the receptacles. The slots may be centered on the rotational axis of the wheel or offset from the rotational axis. The slots are sized to receive the width of the small pack.

In forms of the invention having a rotatable pack turner, the rotatable pack turner may be configured for positioning such that the separator fingers transport bulk packs past the rotatable pack turner to the bulk pack transfer station, when a pack dispatching arrangement incorporating the rotatable pack turner according to the invention is operating in a bulk pack mode. In some forms of the invention, the rotatable pack turner may be removable from the pack dispatching arrangement or at least rendered inoperable such that rotatable pack turner does not intercept packs as they pass through the pack dispatch arrangement during operation in the bulk pack mode.

Some forms of the invention include a back stop and paddle gate operatively disposed downstream and upstream respectively of the bulk transfer station for receiving the bulk pack from the separator fingers during the bulk pack mode of operation. One or both of the separator fingers may be operatively configured to retract after transferring the bulk pack to the back stop and paddle gate. The separator fingers may be further configured and operatively connected for returning to receive the next or another bulk pack from the stack.

Some forms of the invention may include pack turning arrangements other than the pivotable arm and the rotatable pack turner described above.

For example, in some forms of the invention, a pack turning arrangement may include a specific form of a rotatable pack turner in the form of an oscillating pack turner having an axis of rotation. The oscillating pack turner is disposed between the inlet, the bulk transfer station and the small pack transfer station, of the pack dispatching arrangement. Such an oscillating pack turner has at least one pack receptacle therein including a pack directing surface and a face guide surface intersecting the pack directing surface for contacting and supporting the downstream face of the small pack, as the small pack is turned from resting on edge to resting on the downstream face of the small pack by rotation about the axis of rotation of the rotatable pack turner. The oscillating pack turner may pivot alternatively in two directions about its axis of rotation between the inlet and the small pack transfer station, rather than rotating only in a single direction as in other rotatable pack turners described above.

Forms of the invention having an oscillating pack turner may also include an air nozzle operatively connected and configured for directing a jet of air against the upstream face of the small pack. The biasing or urging provided by the jet of air prevents upstream (or otherwise unsupported) sheets of the small pack from lifting off of the small pack while rotating from the inlet to the small pack transfer station.

A separator arrangement, for use in forms of the invention having an oscillating pack turner, may include an upstream finger and a downstream finger configured for respectively supporting the upstream and downstream faces of the small pack as it moves to the pack dispatching arrangement. One or both of the separator fingers may be operatively connected for retracting after the small pack is moved into the receptacle in the oscillating pack turner. The separator fingers may also be operatively connected for returning to receive the next or another small pack from the stack. The process of returning the separator fingers may occur while one or more of the separator finger(s) are retracted.

An oscillating pack turner, according to the invention may be configured for receiving the small pack in a first angular position of the oscillating pack turner, with respect to the inlet and rotational axes of the oscillating pack turner, and for delivering the small pack to the small pack transfer station in a second angular position of the oscillating pack turner with respect to the inlet and rotational axis. The oscillating pack turner may be further configured for returning to the first angular position thereof after delivering the small pack to the small pack transfer station, so that the receptacle in the oscillating pack turner may receive a next small pack from the separator fingers. An oscillating pack turner, according to the invention, may rotate alternately in two directions about its axis of rotation while moving between the first and second angular positions of the oscillating pack turner.

In some forms of the invention having an oscillating pack turner, the oscillating pack turner is configured for positioning such that the separator fingers transport bulk packs past the oscillating pack turner to the bulk pack transfer station, when the pack dispatching arrangement is operating in the bulk pack mode. In some forms of an oscillating pack turner, according to the invention, the small and bulk pack transfer stations and the oscillating pack turner are respectively configured in such a manner that the oscillating pack turner may be rotated about its axis of rotation to an angular position whereat the bulk packs can move past the oscillating pack turner to the bulk transfer station. By virtue of this arrangement, it is not necessary to physically remove the oscillating pack turner when operating in the bulk pack mode.

Various forms of an apparatus, according to the invention, may include one or more of the following in combination with a dispatching arrangement according to the invention: a folding arrangement for delivering a stack of folded sheets with each of the sheets resting on an edge of the sheet; a separator arrangement for receiving the stack of folded sheets from the folder and separating the stack into a stream of either small or bulk packs with the sheets in the small or bulk packs resting on the edges of the sheets for delivery to the inlet of the pack dispatching arrangement; a bulk pack wrapping arrangement for receiving the bulk packs from the bulk pack transfer station of the pack dispatching arrangement; and a small pack wrapping arrangement for receiving the small packs from the small pack transfer station of the pack dispatching arrangement. An apparatus, according to the invention, may also include one or more of: a bulk pack compression arrangement; a small pack conveying arrangement and a bulk pack conveying arrangement. Such a bulk pack compression arrangement may be disposed upstream from the bulk pack wrapper arrangement, or be a part of the bulk pack wrapping arrangement. The small and bulk pack conveying arrangements may be disposed respectively between the small pack transfer station and the small pack wrapper, for the small pack conveying arrangement, and between the bulk pack transfer station and the bulk pack wrapper for the bulk pack wrapping arrangement. All forms of an apparatus, according to the invention, may include a control arrangement operatively connected between elements of the apparatus for cooperatively controlling the elements of the apparatus.

In some forms of the invention, methods of separating and/or dispatching small and bulk packs are provided. These methods use the devices discussed above.

A particular method of handling a stack of folded sheets according to an implementation of the invention includes separating the stack of folded sheets, in a small-pack mode, into a stream of spaced apart small packs of folded sheets; separating the stack of folded sheets, in a bulk-pack mode, into a stream of spaced apart bulk packs of folded sheets; dispatching, in the bulk-pack mode, each bulk pack to a bulk pack transfer station using a pack dispatching arrangement; and dispatching, in the small-pack mode, each small pack to a small pack transfer station.

In one form of a method, the folded sheets in the separated packs are oriented on an edge of the folded sheets with the packs each having an upstream and a downstream face thereof oriented substantially perpendicular to the edge of the folded sheets prior to the steps of dispatching. The step of dispatching, in the bulk-pack mode, each bulk pack to a bulk pack transfer station includes delivering the bulk pack to the bulk pack transfer station with the sheets in the bulk pack resting on the edges of the folded sheets. The step of dispatching, in the small-pack mode, each small pack to a small pack transfer station includes delivering the small pack to the small pack transfer station with the small pack resting on one of the faces of the small pack.

In one form of a method, the steps of dispatching are performed using a pack dispatching arrangement having a turning arrangement and an inlet. The turning arrangement is interposed between the inlet and the bulk pack transfer station and interposed between the inlet and the small pack transfer station. The step of dispatching, in the small-pack mode, each small pack to a small pack transfer station includes rotating the each small pack with the turning arrangement about a rotational axis that is generally perpendicular to the flow of the stream of spaced apart small packs.

In one form of a method, the step of dispatching, in the bulk-pack mode, each bulk pack to a bulk pack transfer station includes passing the bulk pack past the turning arrangement along a path through the pack dispatching arrangement. In a more particular method, the step of dispatching, in the small-pack mode, each small pack to a small pack transfer station includes intercepting the small pack upstream of the bulk pack transfer station with the turning arrangement.

The invention may also take the form of a method for operating and/or constructing an apparatus according to the invention.

Other aspects, objects and advantages of the invention will be apparent from the following detailed description and accompanying drawings of exemplary embodiments of the invention.

BRIEF DESCRIPTION OF THE DRAWINGS

The accompanying drawings together with the description, serve to explain the principles of the invention. In the drawings:

FIG. 5 illustrates the third exemplary embodiment operating in a small pack mode, and FIG. 6 illustrates either the second or third exemplary embodiment operating in a bulk pack mode.

While the invention will be described in connection with certain preferred embodiments, there is no intent to limit it to those embodiments. On the contrary, the intent is to cover all alternatives, modifications and equivalents as included within the spirit and scope of the invention.

DETAILED DESCRIPTION OF THE INVENTION

Figure 1:
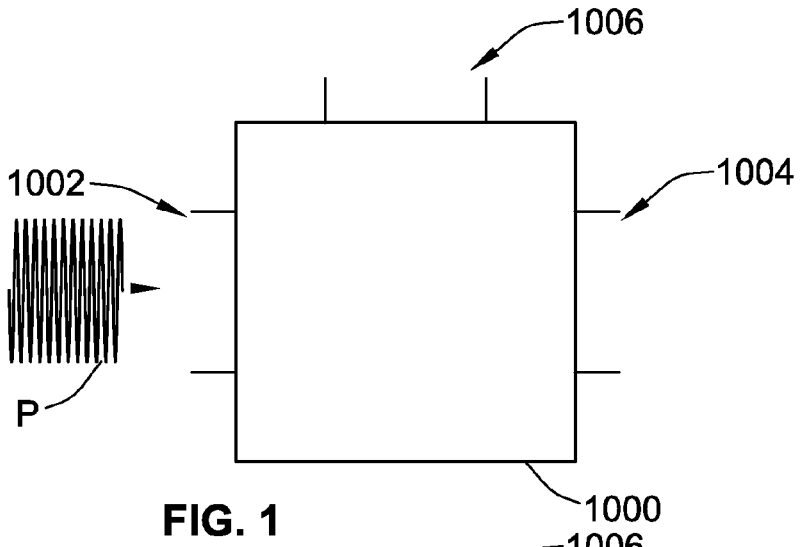
FIGS. 1-3 are side view schematic illustrations of a first exemplary embodiment of a pack dispatching arrangement, according to the invention, with FIGS. 2 and 3 respectively illustrating operation of the pack dispatching arrangement in a bulk pack operating mode and in a small pack operating mode.
Figure 2:
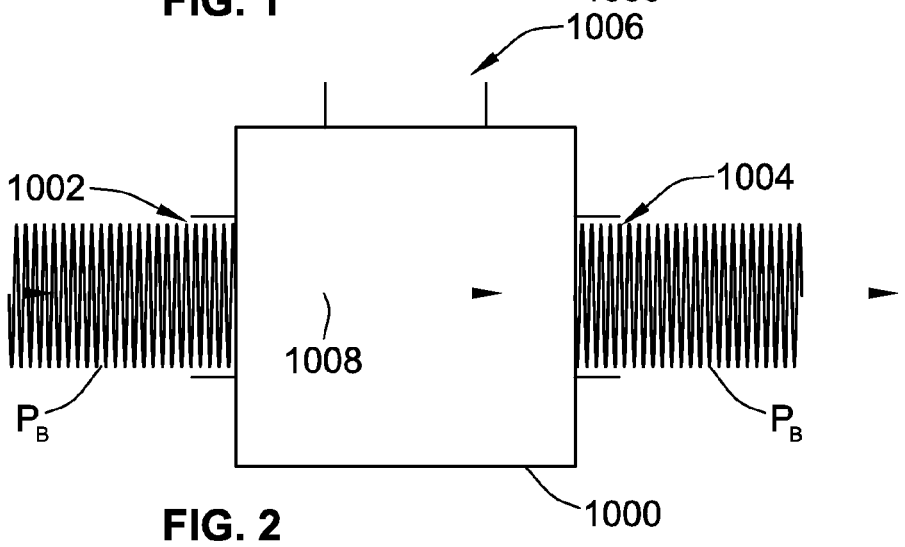
Figure 3:
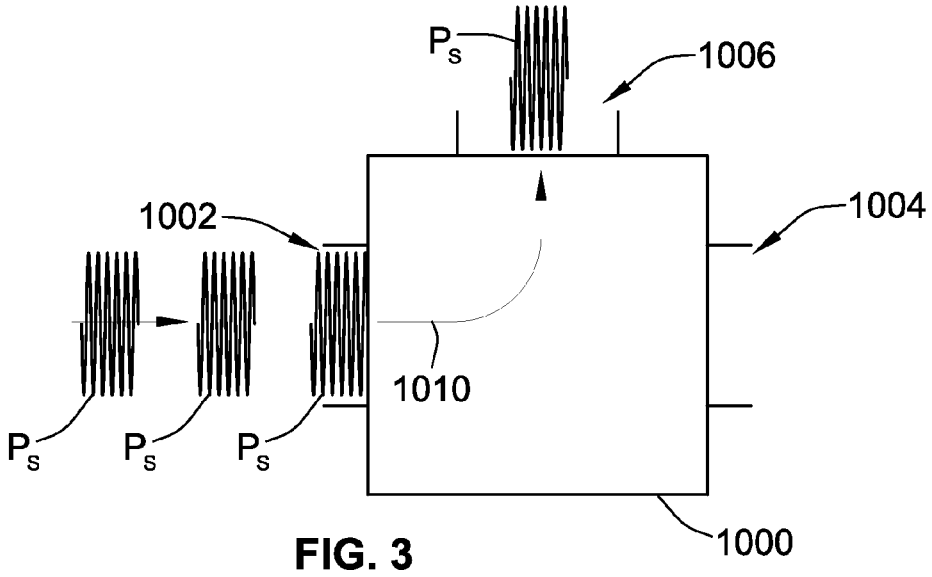

FIGS. 1-3 are schematic illustrations of a first exemplary embodiment of a pack dispatching arrangement 1000, according to the invention, which demonstrate both an apparatus and a method according to the invention.

As shown in FIG. 1, the first exemplary embodiment of the pack dispatching arrangement 1000 includes a pack inlet 1002, a bulk pack transfer station 1004 and a small pack transfer station 1006. As will be described in greater detail below, the pack dispatching arrangement 1000 is operable in a bulk pack mode or a small pack mode for delivering packs (P) of folded sheets received at the pack inlet 1002 alternatively to either the bulk pack transfer station 1004 or the small pack transfer station 1006, depending upon the operational mode selected for operating the pack dispatching arrangement 1000.

As shown in FIG. 2, when the pack dispatching arrangement 1000 is operated in the bulk pack mode, bulk packs $P_B$ are directed straight through the dispatching arrangement 1000, in the manner illustrated by arrow 1008 in FIG. 2, from the bulk pack transfer station 1004. When operating in the bulk pack mode, the small pack transfer station 1006 is bypassed by the bulk packs $P_B$, with the small pack transfer station 1006 being basically inoperative.

As shown in FIG. 3, when the pack dispatching arrangement 1000 is operated in the small pack mold, small packs $P_S$ received at the pack inlet 1002 are generally diverted in the manner illustrated by arrow 1010 in FIG. 3, and delivered to the small pack transfer station 1006.

In the first exemplary embodiment of the pack dispatching arrangement 1000, according to the invention, illustrated in FIGS. 1-3, the folded sheets in the bulk and small packs $P_B$, $P_S$ are received at the pack inlet 1002 with the sheets in the packs, resting on edges of the folded sheets, and delivered to the bulk pack transfer station as shown in FIG. 2 with the bulk packs $P_B$ still resting on the edges of the folded sheets, or alternatively to the small pack transfer station 1006 as shown in FIG. 3 with the small packs $P_S$ still resting on the edges of the folded sheet. It is contemplated, however, that the invention may also be practiced with efficacy in other forms where the orientation of the sheets may be somewhat different than those shown in FIGS. 1-3. It is further contemplated that, in some embodiments of the invention, the small packs might be transferred straight through a pack dispatching arrangement from the pack inlet to the small pack transfer station when the pack dispatching arrangement, according to the invention, is operating in a small pack mode, and that the bulk packs might be diverted from a straight through pass between the inlet and the bulk pack transfer station when operating in a bulk pack mode.

Figure 4:
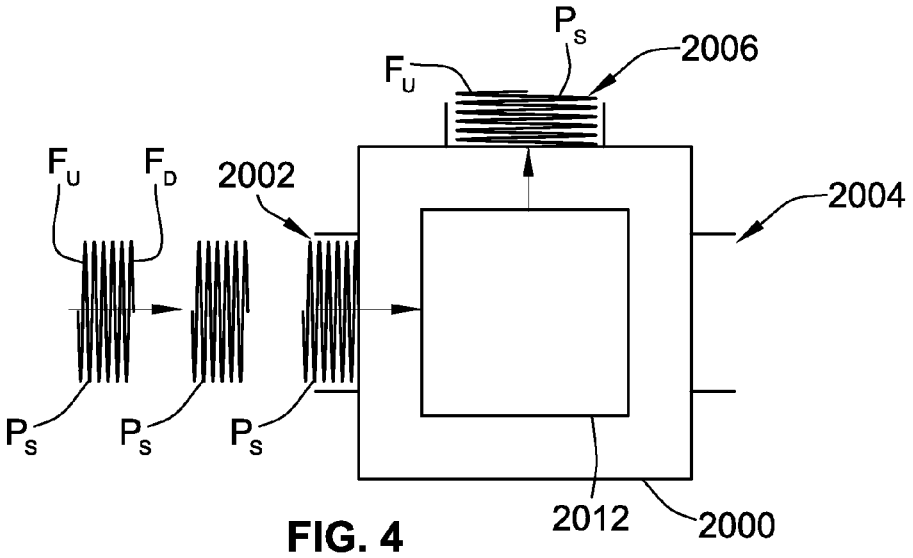
FIG. 4 is a side view schematic illustration of a second exemplary embodiment of a pack dispatching arrangement, according to the invention, with the pack dispatching arrangement including a pack turner for rotating small packs from standing on edge to resting on one of the faces of the small pack.
Figure 5:
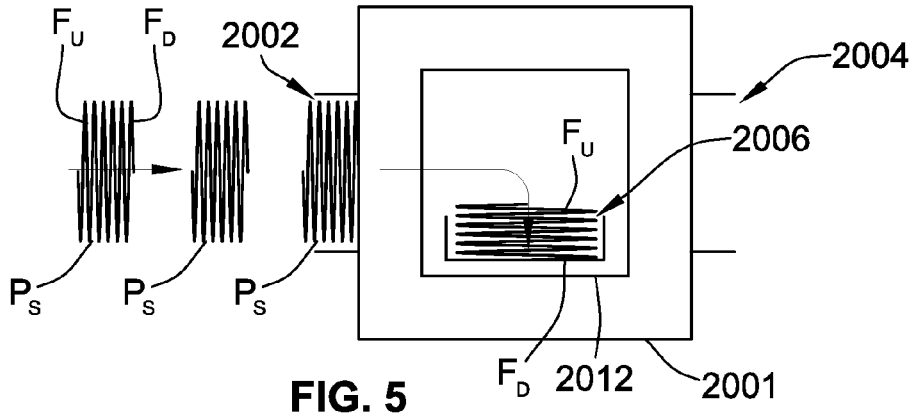
FIGS. 5 and 6 are side view schematic illustrations that illustrate a third exemplary embodiment of a pack dispatching arrangement, according to the invention, with the third exemplary embodiment also including a pack turning arrangement but with the pack turning arrangement of the third exemplary embodiment delivering the rotated small packs in substantially the same plane as they are received at an inlet of the pack dispatching arrangement.
Figure 6:
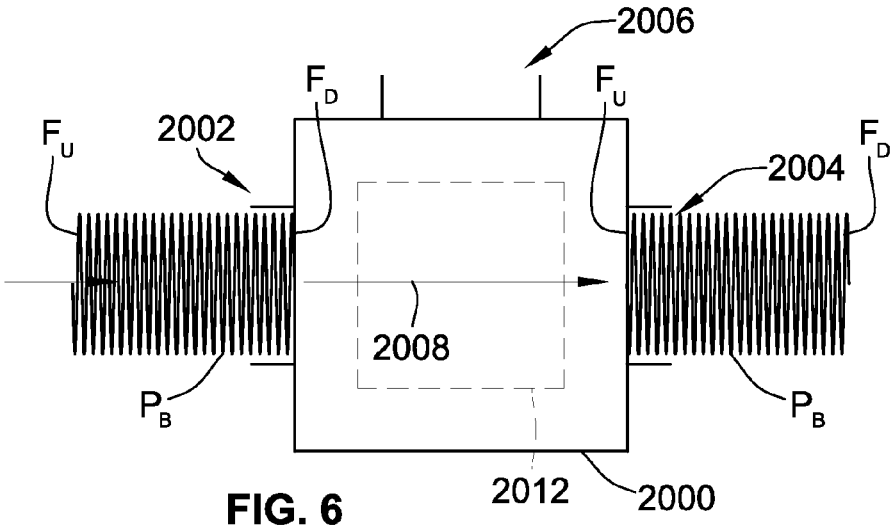

FIGS. 4-6 are schematic illustrations showing other embodiments of apparatuses and methods according to the invention with specific reference to a second exemplary embodiment of a pack dispatching arrangement 2000. In addition to having a pack inlet 2002, a bulk pack transfer station 2004 and a small pack transfer station 2006 similar to those same features of the first exemplary embodiment of the pack dispatching arrangement 1000, the second exemplary embodiment of the pack dispatching arrangement 2000 also includes a pack turning arrangement 2012.

FIG. 4 illustrates the second exemplary embodiment of the pack dispatching arrangement 2000 operating in a small pack mode, with a stream of spaced apart small packs $P_S$, with each of the small packs $P_S$ having the folded sheets therein oriented on an edge of the folded sheets and each of the small packs $P_S$ having an upstream face $F_U$ and a downstream face $F_D$ oriented substantially perpendicular to the edges of the folded sheets. In addition to delivering the small packs $P_S$ from the inlet 2002 to the small pack transfer station 2006, the pack turning arrangement 2012 of the second exemplary embodiment of the pack dispatching arrangement 2000 rotates each of the small packs $P_S$ in such a manner that the small packs $P_S$ are delivered at the small pack transfer station 2006 with the small packs $P_S$ resting on one of the faces $F_U$, $F_D$ of the small pack $P_S$.

For purposes of explanation, FIG. 4 may be thought of as an elevation view showing that the small packs $P_S$ are rotated by the pack turning arrangement 2012 in such a manner that the small packs $P_S$ are delivered, with the small packs $P_S$ resting on their respective downstream faces $F_D$, to a small pack transfer station 2006 disposed at a level above the pack inlet, on a plane extending parallel to but offset from a first plane extending into the inlet 2002 and defining the surface upon which the small packs $P_S$ rest on the edge of the sheets in the pack while entering the pack inlet 2002. With such an arrangement, the rotated small packs $P_S$ may be moved out of the small pack transfer station 2006 along a line of travel extending either into or out of the plane of the drawing as illustrated in FIG. 4.

It will be understood, however, that in embodiments of the invention including a pack dispatching arrangement, such as the second exemplary embodiment 2000, the pack turning arrangement 2012 may deliver the small packs $P_S$ to the small pack transfer station in an orientation such as the one shown in FIG. 5, wherein the small packs $P_S$ enter and exit the pack dispatching arrangement in substantially the same plane. For purposes of illustrating this point further, FIG. 5 may also be considered to represent an elevation view of a version 2001 of the second exemplary embodiment of the pack dispatching arrangement 2000, in which the small packs $P_S$ entering the pack inlet 2002 with the packs resting on the edges of the sheets in the pack are rotated by the pack turning arrangement 2012 of the pack dispatching arrangement 2001 in such a manner that the small packs $P_S$ once again wind up resting on the downstream face $F_D$ of the small packs $P_S$. The rotated small packs $P_S$ may then be transferred laterally out of the small pack transfer station 2004 into or out of the plane of the drawing as depicted in FIG. 5.

As shown in FIG. 6, when the second exemplary embodiment of the pack dispatching arrangement is operated in the bulk pack mode, the pack turning arrangement 2012 is rendered inoperative, as indicated by the dashed lines in FIG. 6, in such a manner that the bulk packs $P_B$ bypass the pack turning arrangement 2012 and move directly from the pack inlet 2002 to the bulk pack outlet 2004 without rotation of the bulk packs $P_B$ and with the bulk packs $P_B$ still resting on the edges of the sheets in substantially the same orientation as received by the pack dispatching arrangement 2000.

As will be understood by those having skill in the art, the present invention may be practiced with efficacy as an apparatus or method for the production of bulk packs or small packs of napkins During the production of such packs of napkins, a folding apparatus will typically produce a continuously building stack of folded or interfolded napkins The stack of folded or interfolded napkins is then separated into a stream of spaced-apart packs of napkins The napkins are then typically wrapped for convenience in the delivery and sell of the bulk or small packs of napkins. Typically, the bulk packs are compressed during, or prior to being wrapped in such a manner that the wrapped bulk packs have an overall length from an upstream to a downstream face of the pack approximately equal to one-half or two-thirds of the uncompressed lengths of the bulk pack. Such processing of the napkins is typically carried out during the pack production process by machinery referred to as a folder, a separator and a wrapper. Such machinery may also use a bulk pack compression arrangement, and include one or more pack conveying arrangements.

Those having skill in the art will also recognize that the present invention may be practiced in a variety of forms utilizing a pack dispatching arrangement according to the invention either standing alone, or in combination with one or more processes or apparatuses disposed upstream and/or downstream from the pack dispatching arrangement and operatively connected thereto.

Figure 7:
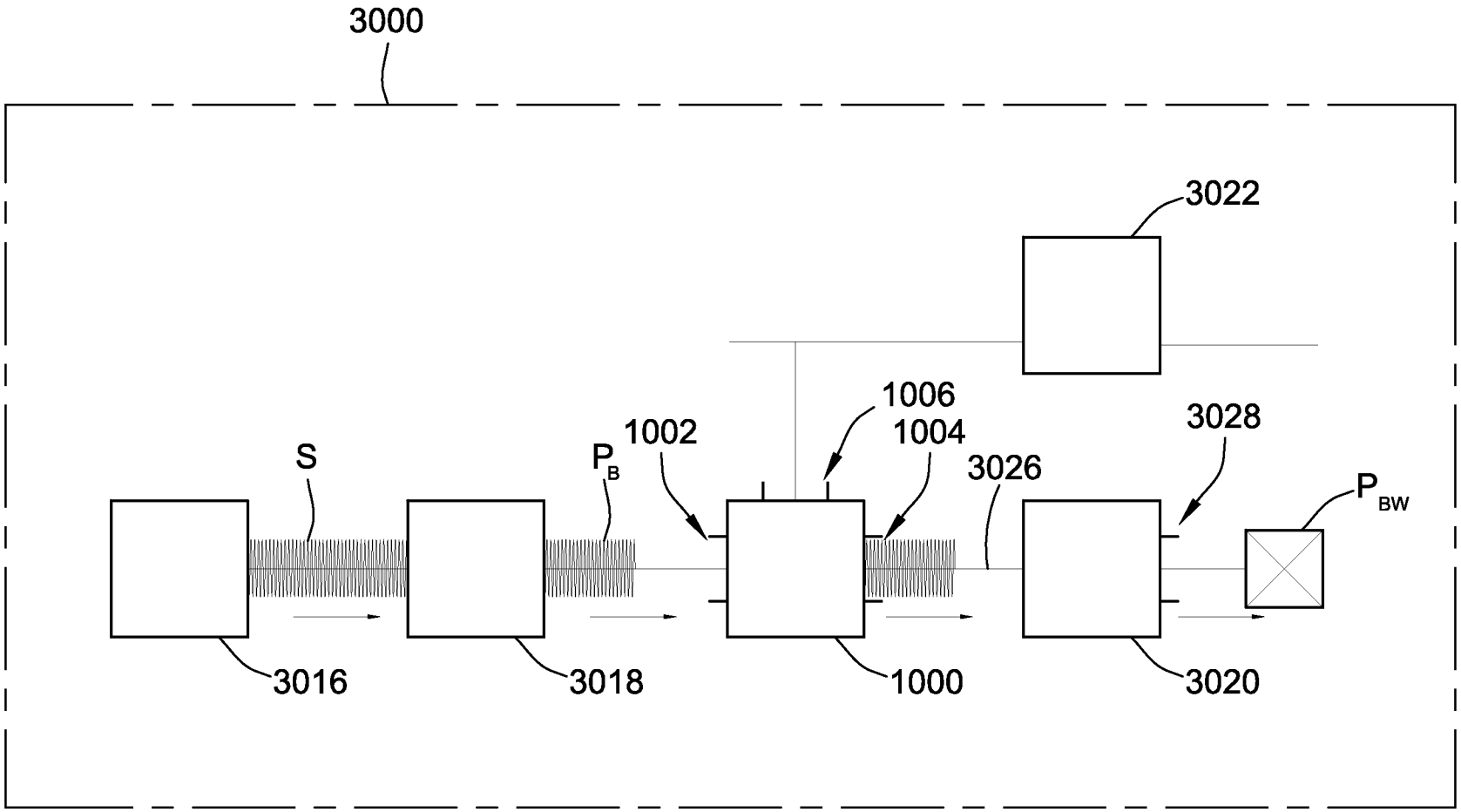
FIGS. 7-9 are side view schematic illustrations that illustrate a first exemplary embodiment of an apparatus for alternatively producing small and bulk pack utilizing the first exemplary embodiment of the dispatching arrangement of FIGS. 1-3.
Figure 8:
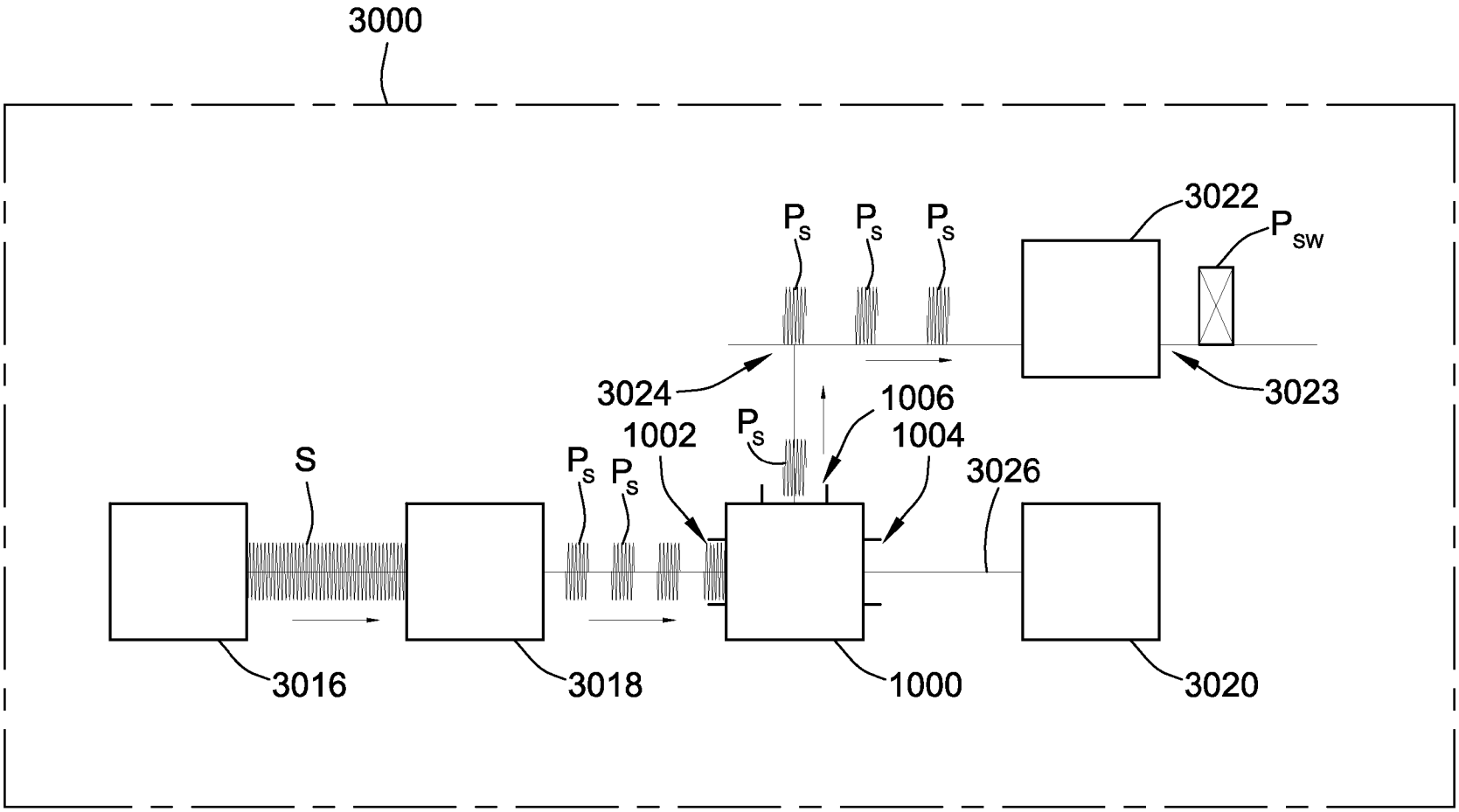

For example, FIGS. 7 and 8 are schematic illustrations of a first exemplary embodiment of an apparatus for alternatively producing small and bulk packs $P_S$, $P_B$ of folded sheets from a continually building stack S of sheets, in which the first exemplary embodiment of the pack dispatching arrangement 1000 is operatively connected to a folder 3016, a separator 3018, a bulk pack wrapper 3020, and a small pack wrapper 3022. As further indicated in FIGS. 7 and 8, the folder 3016 and the separator 3018 are operatively connected to the pack inlet 1002 of the pack dispatching arrangement 1000. Specifically, the folding arrangement 3016 delivers a continually building stack S of folded sheets to the separator 3018. The separator 3018 separates the continually building stack S of sheets into spaced-apart small or bulk packs $P_S$, $P_B$ having a desired number of sheets, and delivers the separated packs $P_S$, $P_B$ to the inlet 1002 of the pack dispatching arrangement 1000.

FIG. 7 illustrates the first exemplary embodiment of the apparatus 3000 operating in a bulk pack mode, in which the separator 3018 delivers the stream of spaced-apart bulk packs $P_B$ to the inlet 1002 of the pack dispatching arrangement 1000, with the bulk packs $P_B$ oriented with the sheets in each bulk pack $P_B$ standing on edge. As further shown in FIG. 7, when operating in the bulk pack mode, the bulk packs $P_B$ are directed by the pack dispatching arrangement 1000 from the pack inlet 1002 to the bulk pack transfer station 1004 without rotation of the bulk packs $P_B$. The bulk packs $P_B$ are transferred from the bulk pack transfer station 1004 of the pack dispatching arrangement 1000 to the bulk pack wrapper 3020 by a bulk pack conveying arrangement 3026. Typically, the bulk packs $P_B$ are compressed prior to being received by the bulk pack wrapper 3020 by a bulk pack compression arrangement (not shown). After passing through the bulk pack wrapper 3020, they are delivered as wrapped bulk packs $P_{BW}$ at an outlet 3028 of the bulk pack wrapper 3020.

FIG. 8 shows the first exemplary embodiment of the apparatus 3000 operating in the small pack mode. As shown in FIG. 8, when operating in the small pack mode, the folder 3016 once again produces a continually building stack S of folded sheets. The separator 3018 is operated in a small pack separation mode in which the continually building stack S is separated into a stream of spaced-apart small packs $P_S$ which are delivered to the pack inlet 1002 of the pack dispatching arrangement 1000, with the small packs $P_S$ oriented such that the small packs $P_S$ are resting on one of the edges of the sheets in the small packs $P_S$. The pack dispatching arrangement 1000 is operated in the small pack mode to direct the small packs $P_S$ from the pack inlet 1002 to the small pack transfer station 1006. The small packs $P_S$ are then transferred from the small pack transfer station 1006 to the small pack wrapper 3022 by a small pack conveying arrangement 3024. The small pack wrapper 3022 wraps the small packs $P_S$ and delivers them at an outlet 3023 of the small pack wrapper 3022 as wrapped small packs $P_{SW}$.

In some embodiments, the small packs $P_S$ are not compressed prior to being wrapped. In other embodiments, however, it will be understood that the small packs $P_S$ could be compressed prior to being wrapped if such compression of the small packs $P_S$ is desired.

Figure 9:
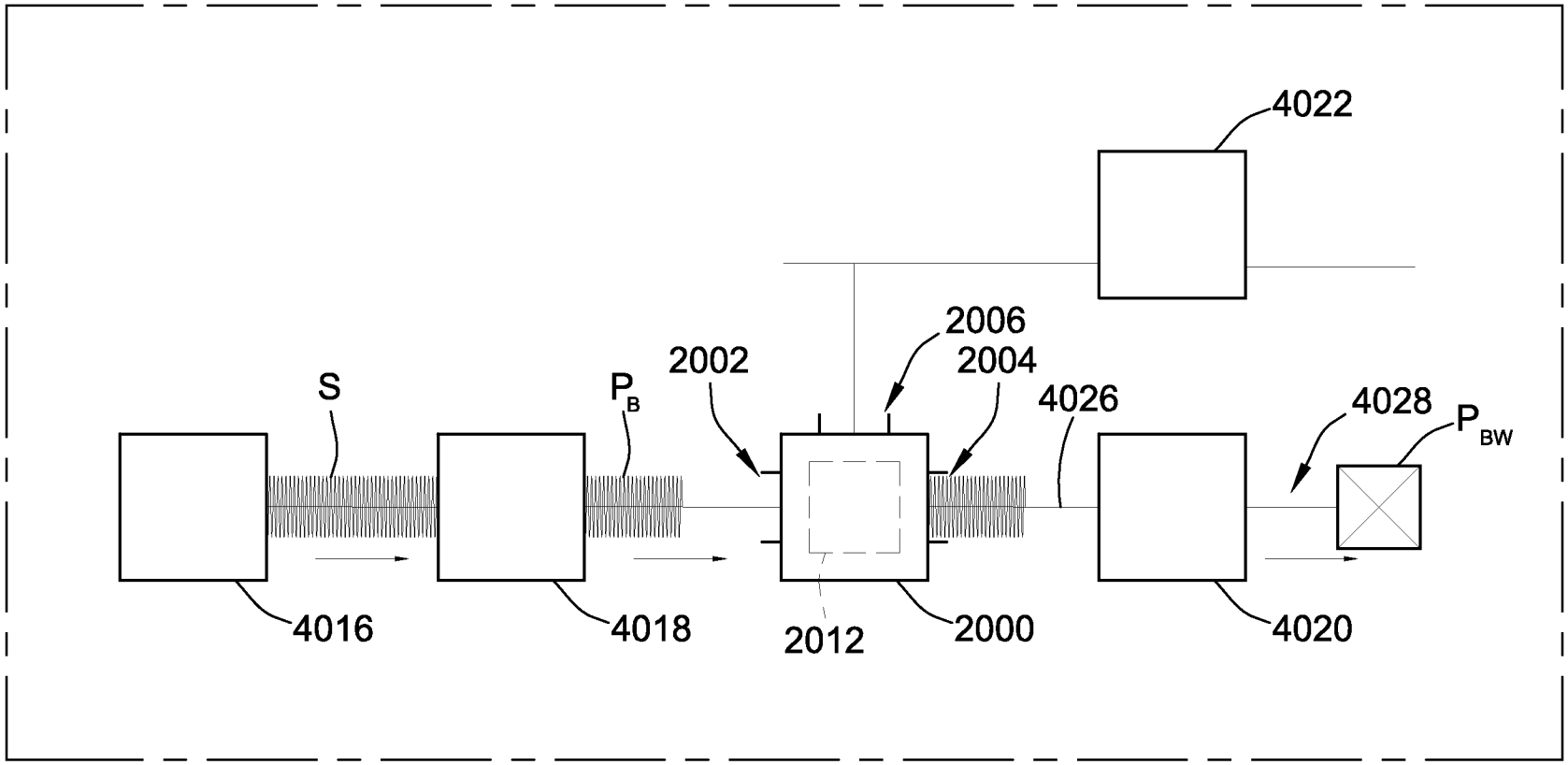
Figure 10:
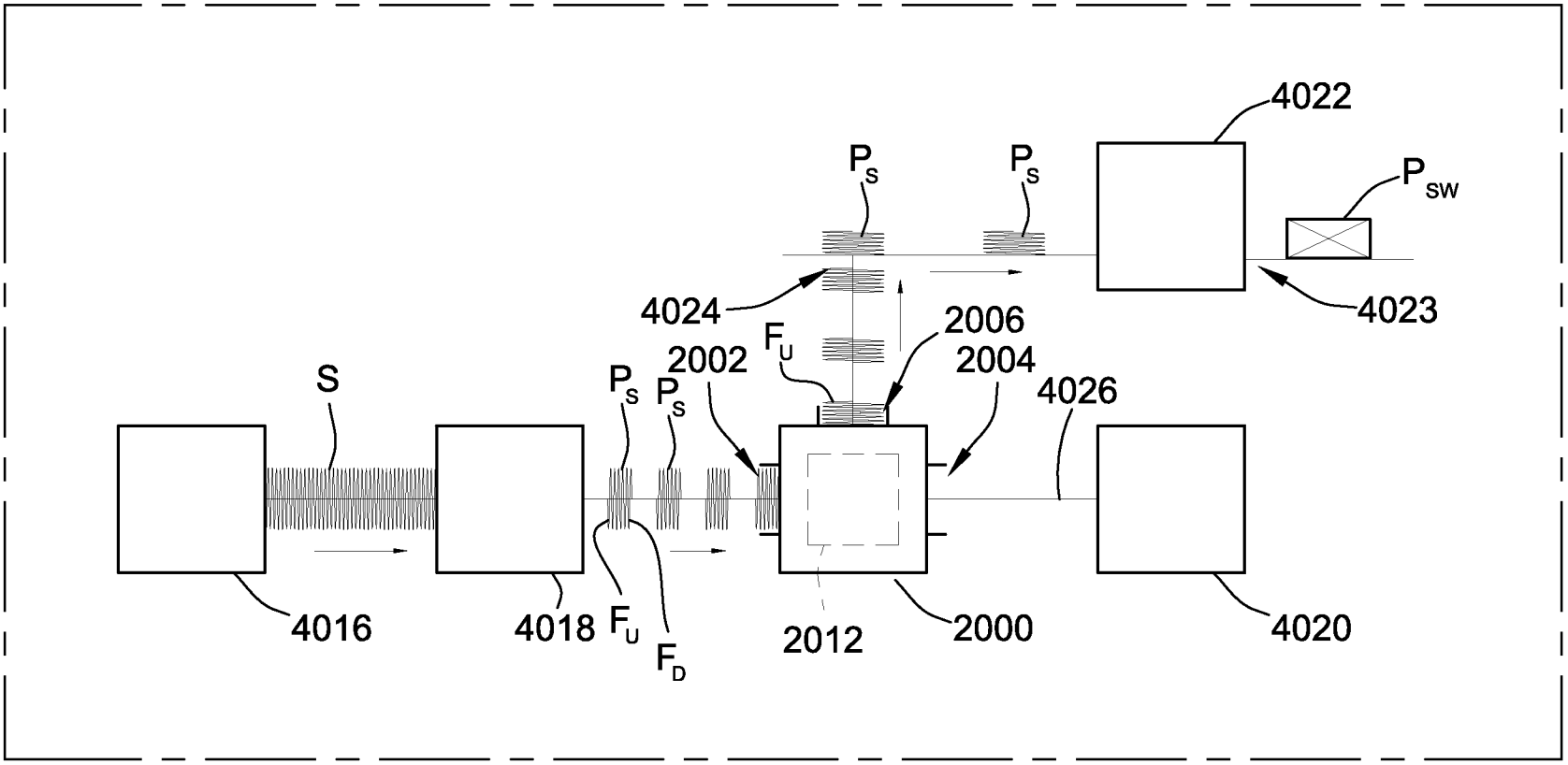
FIG. 10 is a side view schematic illustration of the second exemplary embodiment of an apparatus for alternatively producing small and bulk packs, utilizing a pack dispatching arrangement according to the second exemplary embodiment of the pack dispatching arrangement shown in FIGS. 4 and 6.

FIGS. 9 and 10 are schematic illustrations of a second exemplary embodiment of an apparatus 4000 for alternatively producing small and bulk packs $P_S$, $P_B$ of folded sheets from a continually building stack of sheets, using the second exemplary embodiment of the pack dispatching arrangement 2000, which includes the pack turning arrangement 2012 configured to rotate the small packs and deliver them resting on their downstream faces to a small pack transfer station 2006 disposed on a plane above and extending parallel to the plane defined by the surface upon which the edges of the sheets in the small packs $P_S$ rest while entering the pack inlet 2002, as described above with reference to FIGS. 4 and 6. The second exemplary embodiment of the pack dispatching arrangement 2000 is operatively connected to a folder 4016, a separator 4018, a bulk pack wrapper 4020, and a small pack wrapper 4022, in the second exemplary embodiment of an apparatus 4000 for alternatively producing small and bulk packs of folded sheets from a continually building stack of sheets.

As shown in FIGS. 9 and 10, the folder 4016 and the separator 4018 are operatively connected to the pack inlet 2002 of the pack dispatching arrangement 2000. Specifically, the folding arrangement 4016 delivers a continually building stack S of folded sheets to the separator 4018. The separator 4018 separates the continually building stack S of sheets into spaced-apart packs having a desired number of sheets, and delivers the separated packs to the inlet 2002 of the pack dispatching arrangement 2000.

FIG. 9 illustrates the first exemplary embodiment of the apparatus 4000 operating in a bulk pack mode, in which the separator 4018 delivers the stream of spaced-apart bulk packs $P_B$ to the inlet 2002 of the pack dispatching arrangement 2000, with the bulk packs $P_B$ oriented with the sheets in each bulk pack $P_B$ standing on edge. As further shown in FIG. 9, when operating in the bulk pack mode, the bulk packs $P_B$ are directed by the pack dispatching arrangement 2000 from the pack inlet 2002 to the bulk pack transfer station 2004 without rotation of the bulk packs $P_B$. The bulk packs $P_B$ are transferred from the bulk pack transfer station 2004 of the pack dispatching arrangement 2000 to the bulk pack wrapper 4020 by a bulk pack conveying arrangement 4026. The bulk packs $P_B$ are compressed within the bulk pack wrapper 4020 by a bulk pack compression arrangement (not shown) and delivered as wrapped bulk packs $P_{BW}$ at an outlet 4028 of the bulk pack wrapper 4020.

FIG. 10 shows the second exemplary embodiment of the apparatus 4000 operating in the small pack mode. As shown in FIG. 10, when operating in the small pack mode, the folder 4016 once again produces a continually building stack S of folded sheets. The separator 4018 is operated in a small pack separation mode in which the continually building stack S is separated into a stream of spaced-apart small packs $P_S$ which are delivered to the pack inlet 2002 of the pack dispatching arrangement 2000, with the small packs $P_S$ oriented such that the small packs $P_S$ are resting on one of the edges of the sheets in the small packs $P_S$. The pack dispatching arrangement 2000 is operated in the small pack mode to direct the small packs $P_S$ from the pack inlet 2002 to the small pack transfer station 2006 with rotation of the small packs $P_S$ rotated in such a manner that the small packs $P_S$ are resting on their respective upstream or downstream faces $F_U$, $F_P$, and preferably on their downstream faces $F_D$. The small packs $P_S$ are then transferred from the small pack transfer station 2006 to the small pack wrapper 4022 by a small pack conveying arrangement 4024. The small pack wrapper 4022 wraps the small packs $P_S$ and delivers them at an outlet 4023 of the small pack wrapper 4022 as wrapped small packs $P_{SW}$.

In some embodiments, the small packs $P_S$ are not compressed prior to being wrapped. In other embodiments, however, it will be understood that the small packs $P_S$ could be compressed prior to being wrapped if such compression of the small packs $P_S$ is desired.

As indicated above, the invention may be practiced in a variety of forms and embodiments of methods and apparatuses utilizing one or more of the machines or processes typically utilized for manufacturing small or bulk packs in conjunction with a pack dispatching arrangement according to the invention.

Figure 11A:
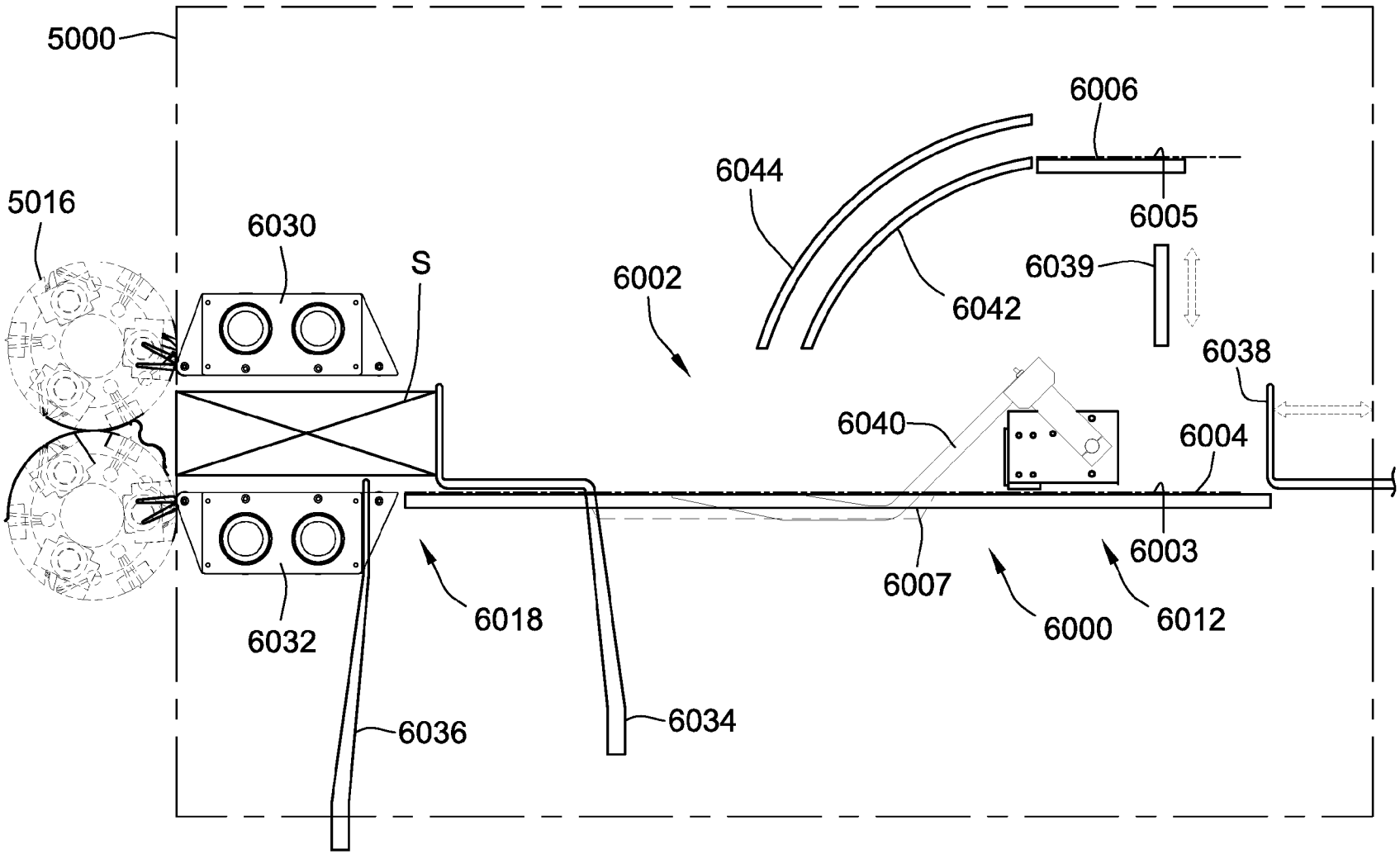
FIGS. 11A-11C illustrate the construction of a first exemplary embodiment of a separator/dispatcher arrangement, according to the invention, including a pack dispatching arrangement having a pivotable arm.
Figure 11B:
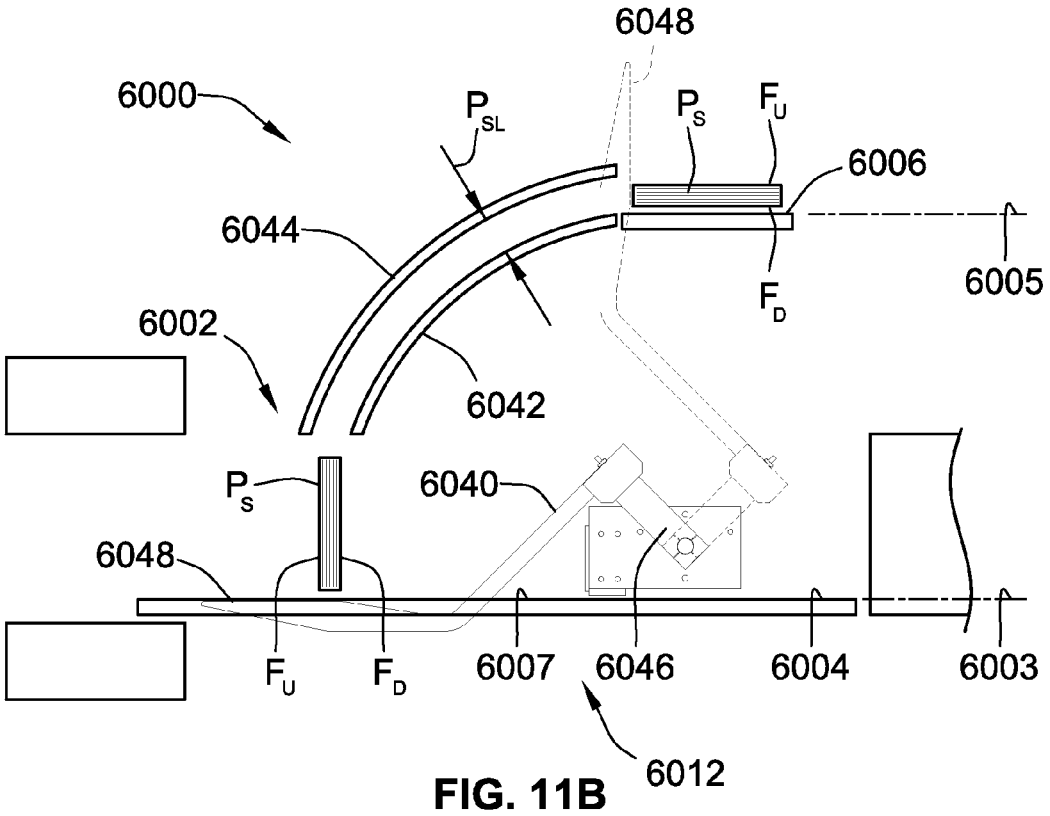
Figure 11C:
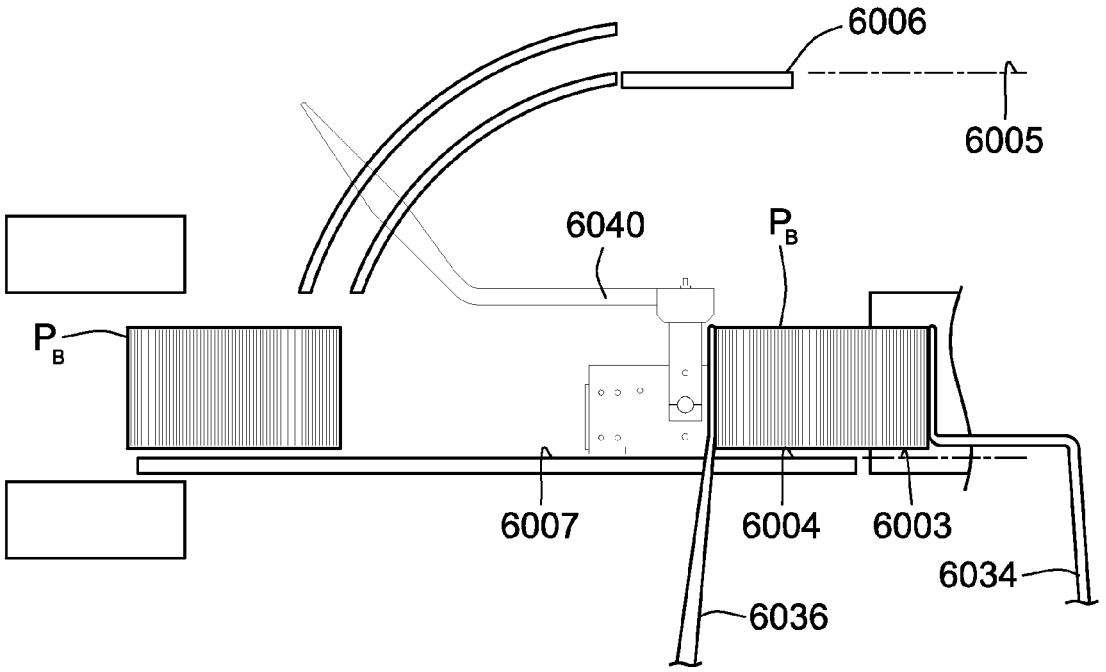

For example, FIGS. 11A-11C show the structure of a first exemplary embodiment of a separator/dispatcher arrangement 5000, according to the invention. As indicated in FIG. 11A, the first exemplary embodiment of the separator/dispatcher arrangement 5000 includes a pack dispatching arrangement 6000, according to the invention, in combination with a separator arrangement 6018. The pack dispatching arrangement 6000 is of the type generally described above with reference to FIGS. 4 and 6, in which a pack turning arrangement 6012 of the pack dispatching arrangement 6000 is utilized for rotating small packs $P_S$ from an orientation with the pack standing on the edges of the sheets in the small $P_S$ at the pack inlet 6002 of the pack dispatching arrangement 6000 to an orientation with the small packs $P_S$ resting on a downstream face $F_D$ of the small pack Ps at the small pack transfer station 6006.

As further indicated in FIGS. 11A and 11B, the surface of the small pack transfer station 6006 upon which the downstream face $F_D$ of the rotated small packs $P_S$ extends along a plane 6005 which is offset above (as shown in FIGS. 11A and 11B) a parallel plane 6003 defined by the surface of a common bed 6007 of the separator arrangement 6018 and the pack dispatching arrangement 6000. The bulk pack transfer station 6004 is defined by a portion of this common bed 6007, with the coincident upper surface of the common bed 6007 and the plane 6003 forming the surface upon which the small packs rests on the edges on the sheets prior to their being rotated from the position as received at the pack inlet 6002 to the position shown in FIG. 11B at the small pack transfer station where at the small packs $P_S$ have been rotated to rest upon the downstream face $F_D$ of the small pack $P_S$.

As shown in FIG. 11A, the separator arrangement 6018 is generally of a type disclosed in commonly assigned U.S. patent applications Ser. Nos. 12/759,780 and 12/966,666. It will be understood, however, that in other embodiments of the invention a separator arrangement may take any other applicable form for practice of the invention, including other known forms of separators utilizing multiple count and separator fingers and star wheels.

As generally illustrated in FIG. 11A, the separator arrangement 6018 of the first exemplary embodiment of the separator/dispatcher arrangement 5000, according to the invention, includes an upper and a lower count finger cassette 6030, 6032 operatively connected for cooperative operation with first and second separator fingers 6034, 6036, an end gate 6038 and a paddle gate 6039. The portion of the bed 6007 between the end gate 6038 and the paddle gate 6039 define the bulk pack transfer station in the first exemplary embodiment of the separator/dispatcher arrangement 5000.

The first and second separator fingers 6034 and 6036 are operatively connected for movement longitudinally along slots in the common bed 6007, and also transversely to extend above or retract below the upper surface of the bed 6007. The upper and lower count finger cassettes 6030, 6032 include a series of belt-mounted fingers which can be inserted into the continually building stack S of folded sheets at desired intervals to create a series of spaced-apart small packs $P_S$ when the separator arrangement 6018 is operated in a small pack mode (FIG. 11B), and alternatively for creating a series of spaced-apart bulk packs $P_B$ when the separator arrangement 6018 is operating in a bulk pack operating mode (FIG. 11C).

As further indicated in FIG. 11A, the continuously building stack S of folded sheets is generated and delivered to the separator/dispatcher arrangement 5000 by a folding arrangement 5016 in the form of a pair of counter rotating folding rolls, in the form illustrated in FIG. 11A. It will be understood, however, that in other forms of the invention, the continually building of stack of folding sheets S may be delivered to an apparatus or method according to the invention by any appropriate means or method.

As described in more detail below, and in the previously referenced commonly assigned patent applications Ser. Nos. 12/759,780 and 12/966,666, the first and second separator finger 6034, 6036 work in cooperation with the fingers of the upper and lower count finger cassettes 6030, 6032 to support the downstream and upstream faces $F_D$, $F_U$, respectively, of the small or bulk packs $P_S$ or $P_B$ separated from the continually building stack S by the count fingers of the upper and lower count finger cassettes 6030, 6032.

As illustrated in FIG. 11C, when the separator/dispatcher arrangement 5000 is operating in the bulk pack mode, the first and second separator finger 6034, 6036 cooperate with the pack dispatching arrangement 6000 to transport bulk packs $P_B$ along the common bed 6007, past the pack turning arrangement 6012, to the bulk pack transfer station 6004 disposed between the end gate 6038 and the paddle gate 6039. When the separator/dispatcher arrangement 5000 is operating in the small pack mode, the first and second separator finger 6034, 6036 transport the small packs $P_S$ from the separator 6018 to the pack turning arrangement 6012.

As shown in FIG. 11B, the pack turning arrangement 6012 in the pack dispatching arrangement 6000 includes a pivotable arm 6040, and a pair of guides 6042, 6044 for guiding the downstream and upstream faces $F_D$, $F_U$ of the small packs $P_S$ as the pivotable arm 6040 delivers the small packs $P_S$ from the pack inlet 6002 to the small pack transfer station 6006, when the separator/dispatcher arrangement 5000 is operating in the small pack mode.

As also shown in FIG. 11B, a proximal end 6046 of the pivotable arm 6040 is pivotably attached and fixed with respect to the inlet 6002 of the pack dispatching arrangement 6000. The pivotable arm 6040 also defines a pack directing surface 6048 for contacting the edges of the sheets in each small pack $P_S$ during operation of the pack dispatching arrangement 6000 in the small pack mode. The pack directing surface 6048 urges the small pack $P_S$ to turn from the orientation as received at the pack inlet 6002 with the small packs $P_S$ resting on the edges of the sheets in the small packs $P_S$, toward the orientation at the small pack transfer station 6006 with the small pack $P_S$ resting on one of the faces, i.e. the downstream face $F_D$ of the small pack $P_S$ as shown in FIG. 11B.

Figure 12A:
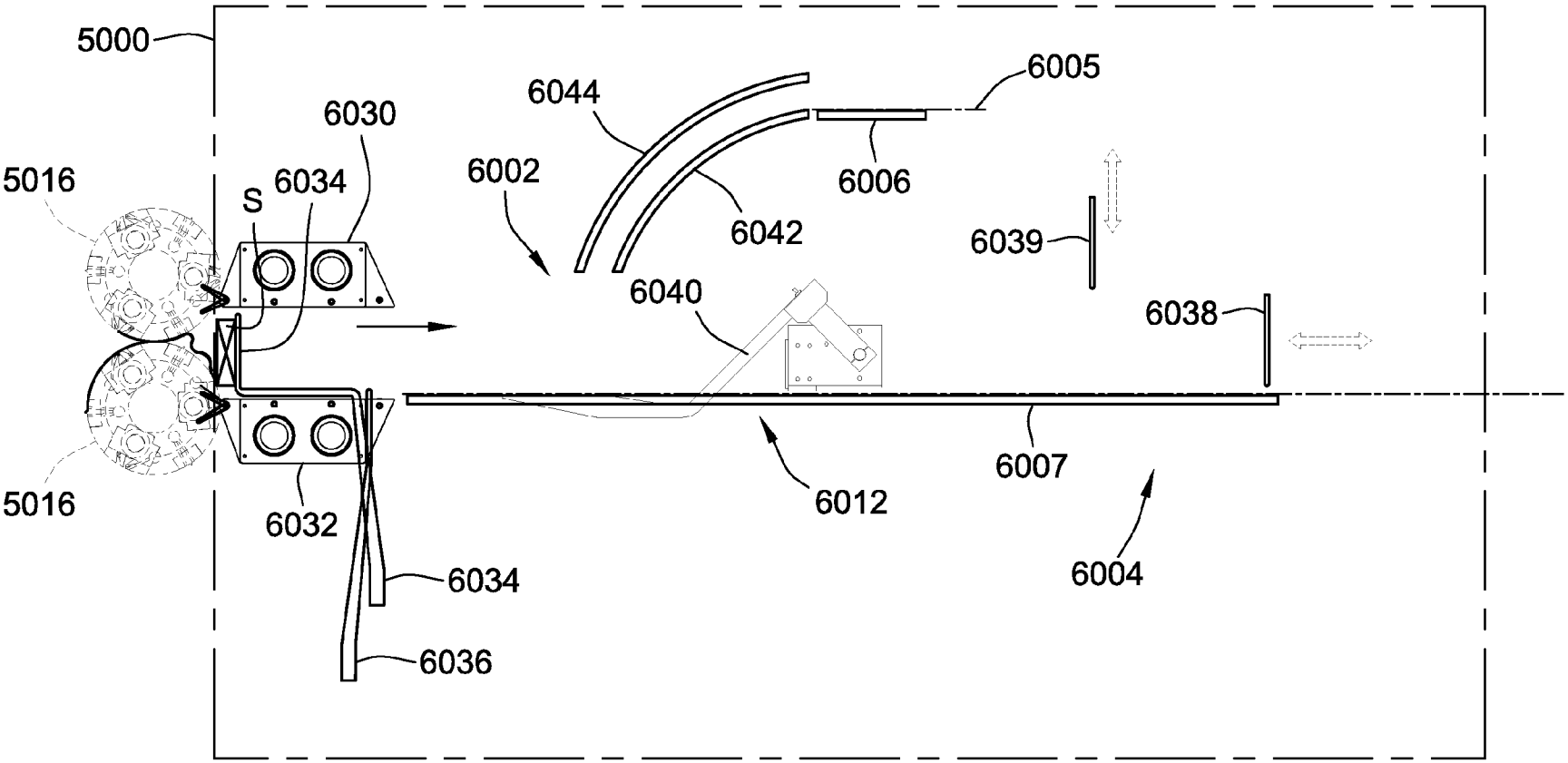
FIGS. 12A-12N are sequential schematic illustrations of the exemplary embodiment of the separator/dispatcher arrangement of FIGS. 11A-11C, illustrating construction and operation in both small pack and bulk pack operating modes.

Operation of the first exemplary embodiment of the separator/dispatcher arrangement 5000 is described below with reference to FIGS. 12A-12N. FIGS. 12A-12D are generally applicable to operation in both the small and bulk pack modes. FIGS. 12E-12H are applicable to operation in the small pack mode. FIGS. 12I-12N show operation in the bulk pack mode. Commonly assigned U. S. patent applications Ser. Nos. 12/759,780 and 12/966,666 provide a more detailed description of the construction and operation of the count finger cassettes 6030, 6032.

As illustrated in FIG. 12A, the first separator finger 6034 is supporting the downstream face $F_D$ of the continually building stack S, as additional folded sheets are added to the stack S by the folding rolls 5016. The separator/dispatcher 5000 is configured to move the first separator finger 6034 in the downstream direction at the build rate, to accommodate the sheets being added at the upstream end of the stack S by the folding rolls 5016. As further shown in FIG. 12A, the count fingers of count finger cassettes 6030, 6032 are all shown in a retracted ready position at an upstream end of the separator/dispatcher 5000, in preparation for their being inserted into the stack S to begin the separation process. As further shown in FIG. 12A, the second separator finger 6036 is in a refracted position wherein the second separator finger 6036 does not extend above the common bed 6007 into the stacking region.

Figure 12B:
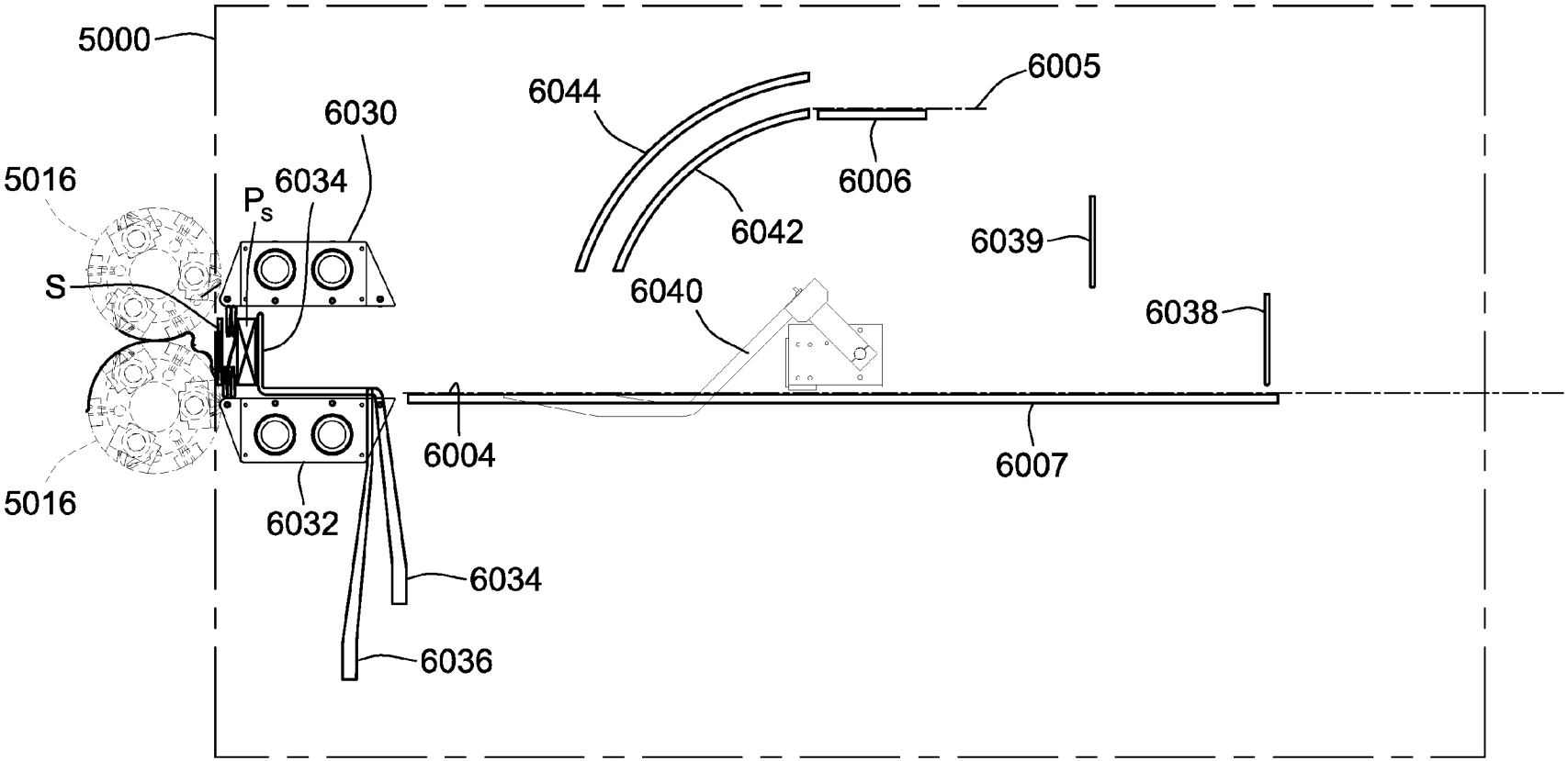
FIGS. 12O-12T illustrate construction details in operative connection of a pair of pack face guides utilized in embodiments of the invention having a pack turning arrangement utilizing a pivotable arm, of the type shown in FIGS. 11A-11C and FIGS. 12A-12N.

As shown in FIG. 12B, four count fingers have been inserted sequentially into the stack S, into the spaces between six consecutive folds in the stack S, to separate the stack S into a downstream portion containing a desired number of folded sheets, to thereby form a completed pack. The folding rolls 5016 continue to deposit folded sheets on an upstream side of the two upstream count fingers to thus continue building the next pack. As the next pack continues to build, the separator/dispatcher 5000 continues to move the count fingers and the first separator finger 6034 in the downstream direction through the stacking region at the build rate, to accommodate additional folded sheets being added to the upstream side of the next pack by the folding rolls 5016. As further shown in FIG. 12B, the second separator finger 6036 remains in its retracted and ready position below the common bed 6007.

Figure 12C:
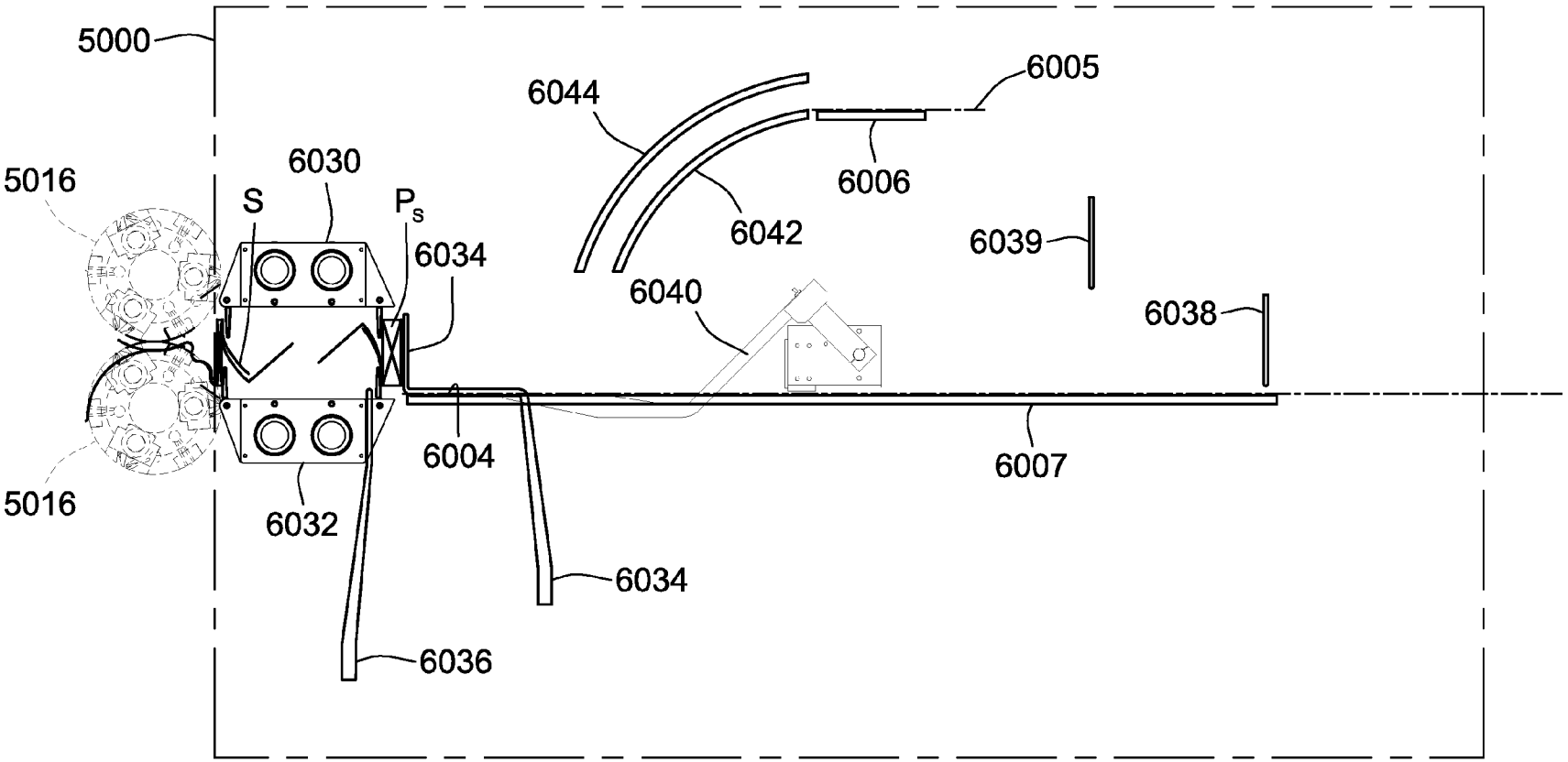

FIG. 12C illustrates a point in operation of the separator/dispatcher 5000, where the two upstream count fingers continue to move together in the downstream direction at the build rate, as the folding rolls 5016 continue to add new folded sheets to the upstream side of the next pack. The two downstream count fingers have been driven together in a downstream direction, by the separator/dispatcher 5000, at a rate faster than the upstream pair of count fingers, to thereby open a gap between the upstream and downstream pairs of count fingers. The first separator finger 6034 has been moved in the downstream direction substantially in unison with the downstream count fingers, to thereby move the completed pack to the downstream end of the stacking region.

Figure 12D:
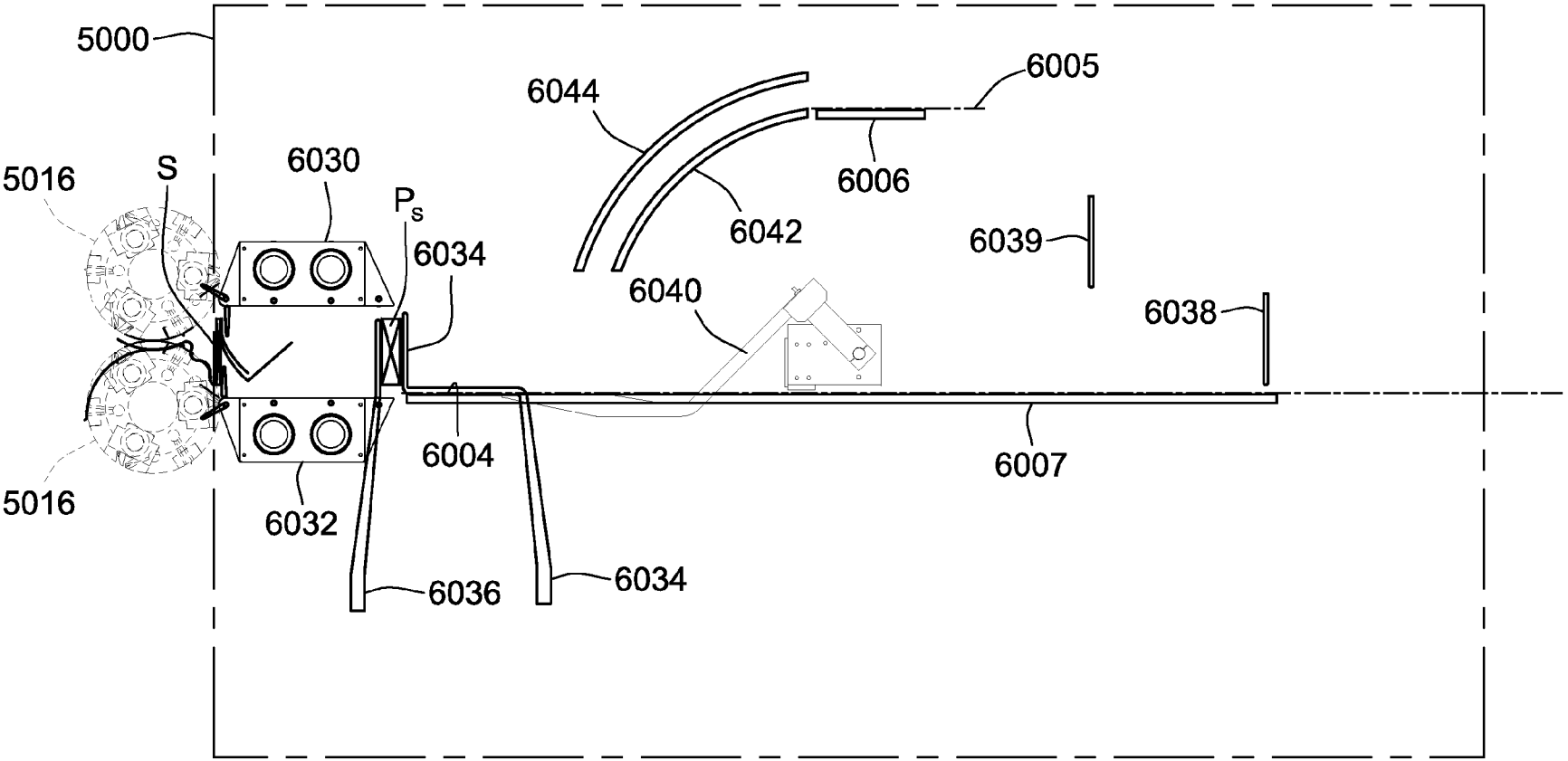

At the point in operation of the separator/dispatcher 5000 shown in FIG. 12D, the second separator finger 6036 has been inserted into the gap in the stacking region between the upstream and downstream pairs of count fingers, to bear against an upstream surface of the completed pack, and the downstream count fingers have been retracted by being driven around the downstream ends of the first and second count finger cassettes 6030, 6032, and returned to a ready position at the upstream end of the count finger cassettes 6030, 6032. The downstream count fingers continue to be moved in the downstream direction by the separator/dispatcher 5000 to accommodate the additional folded sheets being added to the upstream end of the next pack.

Figure 12E:
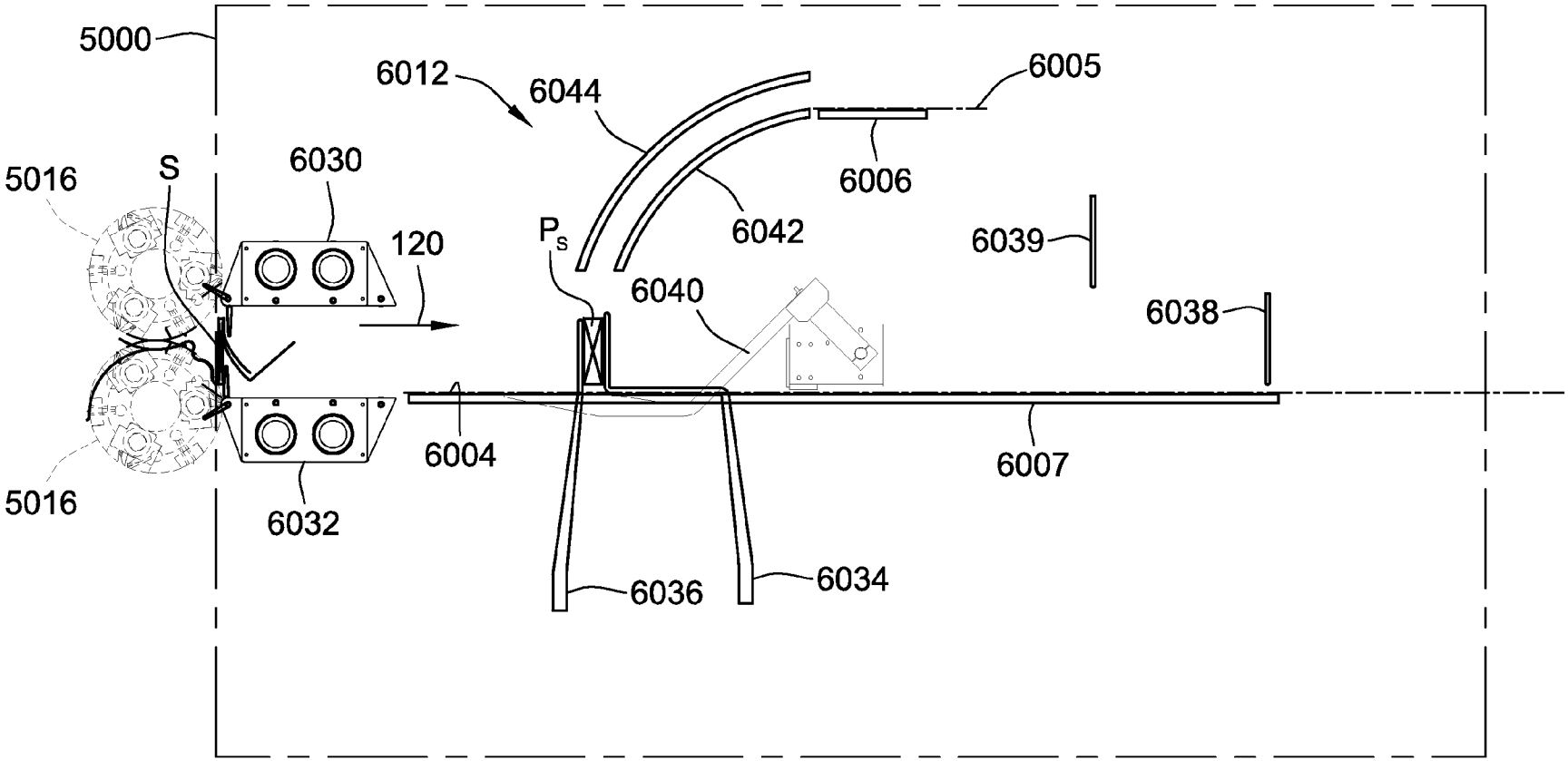

As shown sequentially in FIGS. 12D and 12E, when the separator/dispatcher 5000 is operating in the small pack mode, once the second separator finger 6036 has been inserted into the gap in the stacking region, to support the upstream end of the completed pack, the first and second separator fingers 6034, 6036 move the completed pack to a point along the common bed 6007, as illustrated in FIG. 12E, whereat the completed pack is aligned below the lower ends of the first and second pack turning guides 6042, 6044 for transfer to the pack turning arrangement 6012. During the time in which the first and second separator fingers 6034, 6036 are moving the completed pack out of the stacking region, the upstream count fingers continue to move in a downstream direction 120 at the build rate, to accommodate additional sheets being added to the upstream end of the next pack. During this same period of time, the downstream count fingers remain in the ready retracted position as shown in FIGS. 12D and 12E.

Figure 12F:
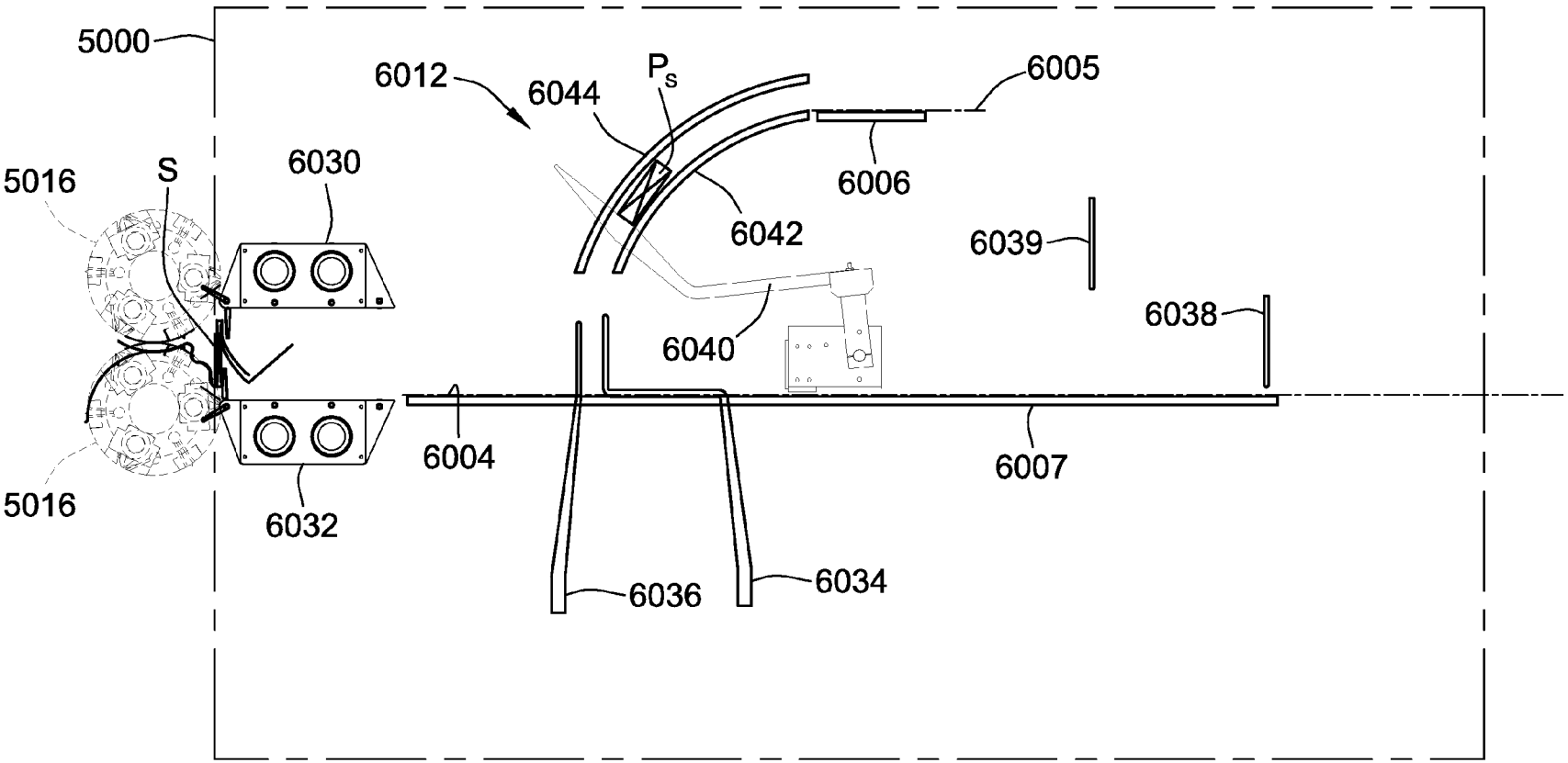
Figure 12G:
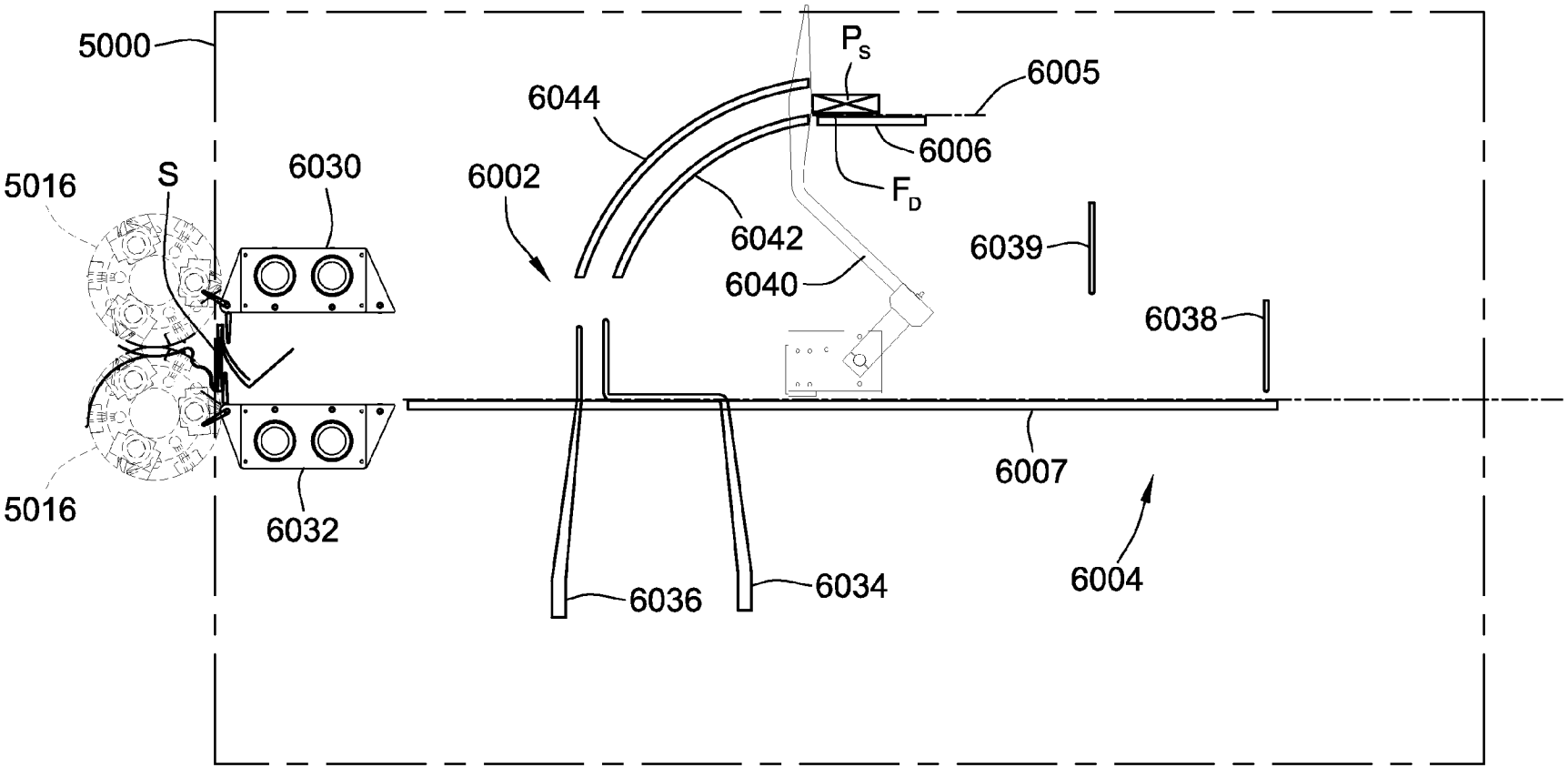

As shown sequentially in FIGS. 12F and 12 G, the pivotable arm 6040 of the pack turning arrangement 6012 is then actuated so that the pack dispatching surface 6048 of the pivotable arm 6040 can move the completed pack out of the grip of the first and second separator fingers 6034, 6036 and along the space defined between the first and second pack face guides 6042, 6044 to the small pack transfer station 6006. By virtue of this operation, the completed pack is turned from having the pack oriented with the folded sheets in the pack resting on edge on the common bed 6007 to an orientation in which the completed pack is resting on the downstream face $F_D$ of the completed pack at the small pack transfer station 6006.

Figure 12H:
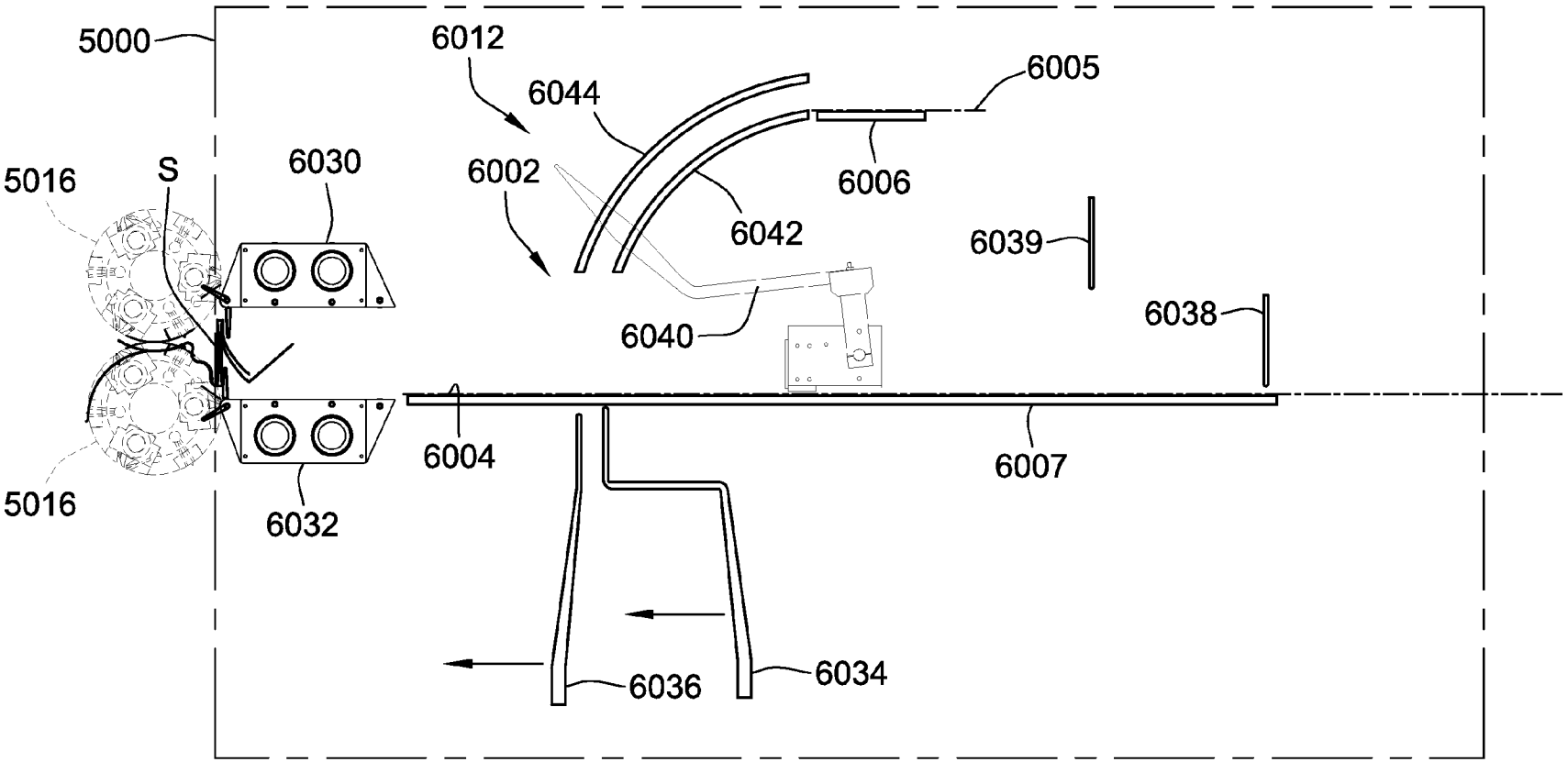

As shown in FIG. 12H, once the first and second separator fingers 6034, 6036 have released the completed pack to the pack turning arrangement 6012, the first and second separator fingers 6034, 6036 are returned to a ready position below and adjacent the upstream end of common bed 6007 whereat they do not extend into the stacking region. As further shown in FIG. 12H, once the pivotable arm has transported the competed pack to the small pack transfer station 6006, the pivotable arm 6040 rotates back to a ready position below the common bed 6007, as shown in FIGS. 12A-12E, to await the next pack.

The first separator finger 6034 is moved upward through the common bed 6007 and in an upstream direction into the stacking region, and the upstream count fingers, are moved to a retracted ready position to transfer the downstream surface of the next pack to the first separator finger 6034, as shown in FIG. 12A. From this point, the separator/dispatcher arrangement 5000 repeats the process described above in relation to FIGS. 12A-12H, to separate the next pack 150 from the stack S when the desired number of sheets have been deposited by the folding rolls 5016 against the upstream end of the next pack. The process described hereinabove is repeated to form each successive pack from the stream S of folded sheets issuing from the folding rolls 5016 into the stacking region.

FIGS. 12I-12N illustrate operation of the separator/dispatcher arrangement 5000 operating in the bulk pack mode. The first step in accomplishing a separation of a bulk pack from a continuously building stack S is essentially the same as described above with reference to FIG. 12A, and will not be repeated here.

Figure 12I:
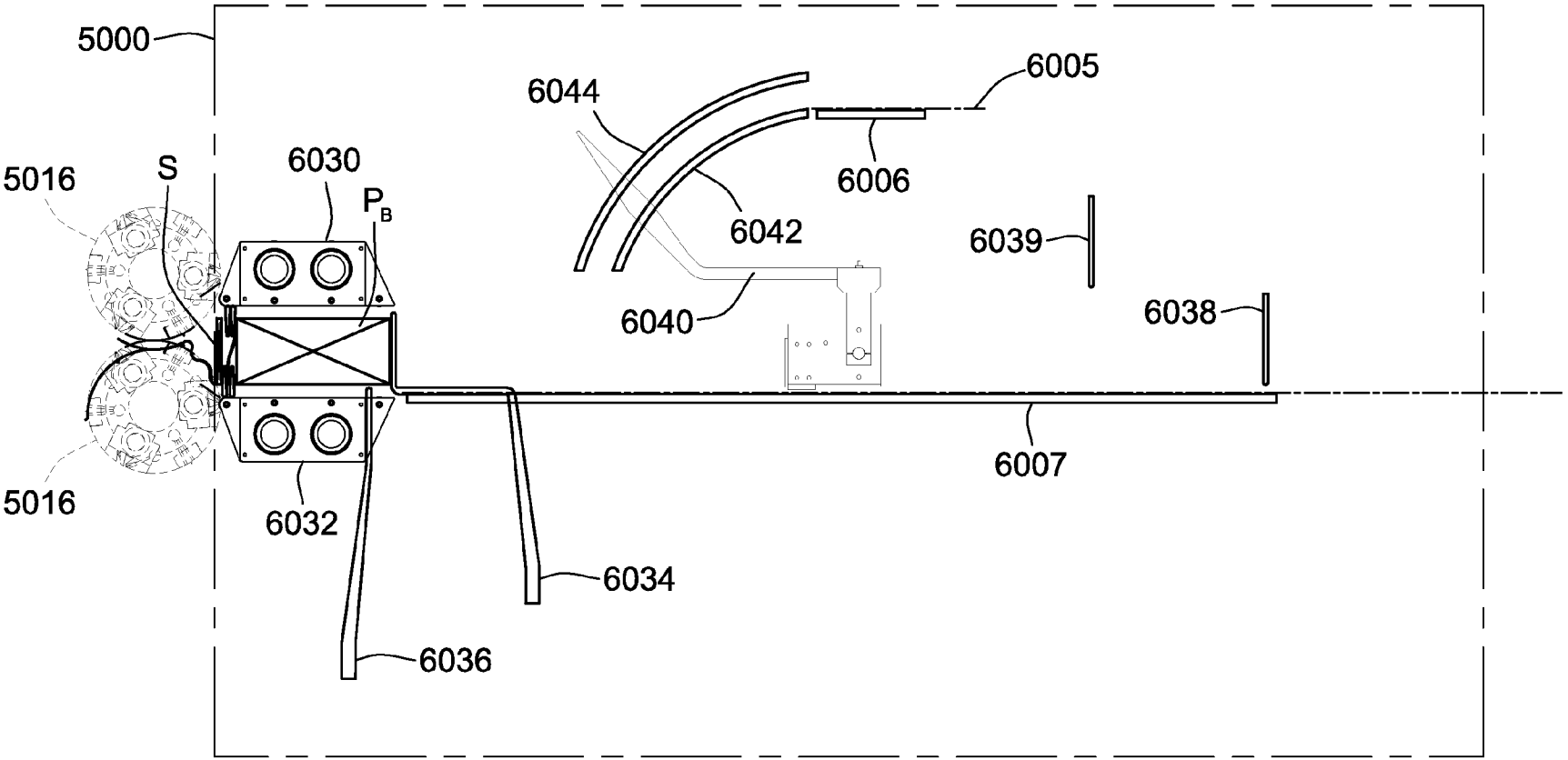

FIG. 12I illustrates a point in the bulk pack separation mode essentially equivalent to the point in the small pack operational mode described above with regard to 12B. At the point shown in FIG. 12I, the upstream and downstream count fingers of the first and second count finger cassettes 6030, 6032 have rotated into the stacking region to begin the separation process. The downstream end of the completed pack is supported by the first separator finger 6034. The stack S continues to build the next pack upstream of the upstream pair of count fingers.

Figure 12J:
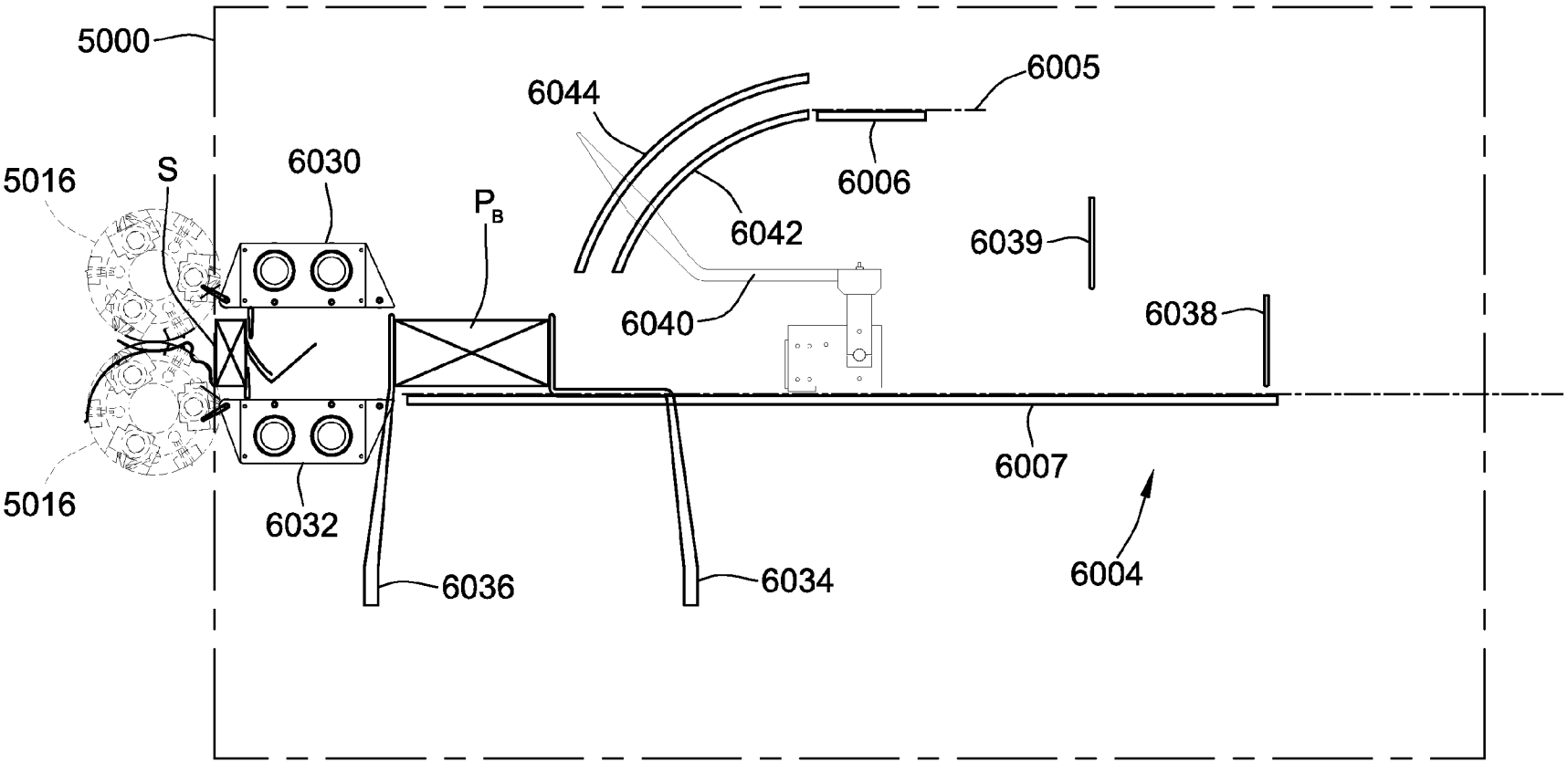

FIG. 12J illustrates a point during operation in the bulk pack mode whereat the downstream count fingers have moved away from the upstream fingers to create a gap between the upstream and downstream fingers into which the second separator finger 6036 can be inserted by being raised through the common bed 6007 to assume support of the upstream end of the completed pack. At the point shown in FIG. 12J, the downstream count fingers have already rotated back to their ready position at the upstream ends of the first and second count finger cassettes 6030, 6032. The first and second separator fingers 6034, 6036 are moving in a downstream direction to transport the completed pack past the pack turning arrangement 6012. The stack S continues to build upstream of the upstream count fingers to eventually form the next completed pack.

Figure 12K:
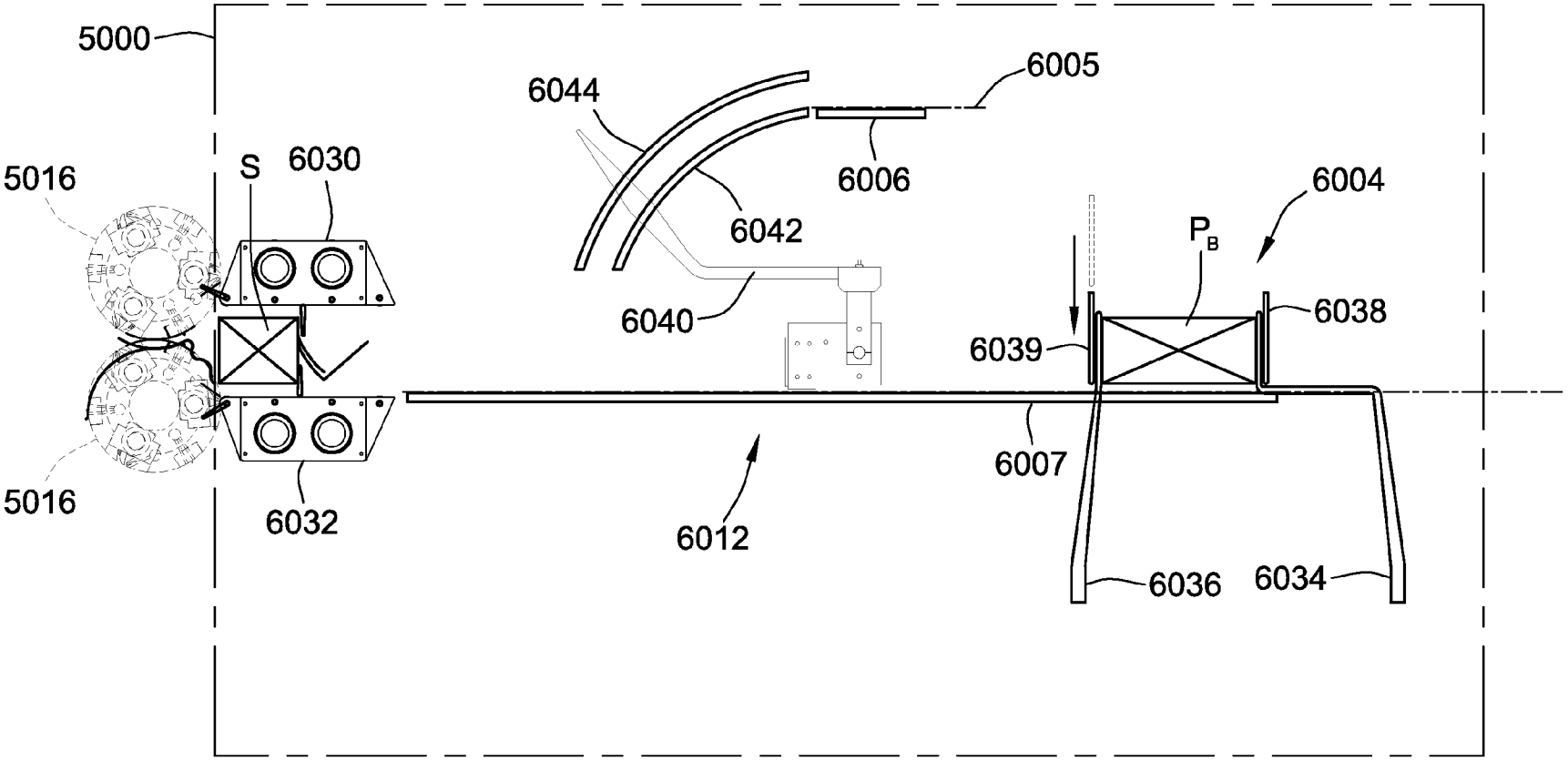

In FIG. 12K, the first and second separator fingers 6034, 6036 have transported the completed the pack along the common bed 6007 to the bulk pack transfer station 6004, and the paddle gate 6039 is descending just upstream from the second separator finger 6036.

Figure 12L:
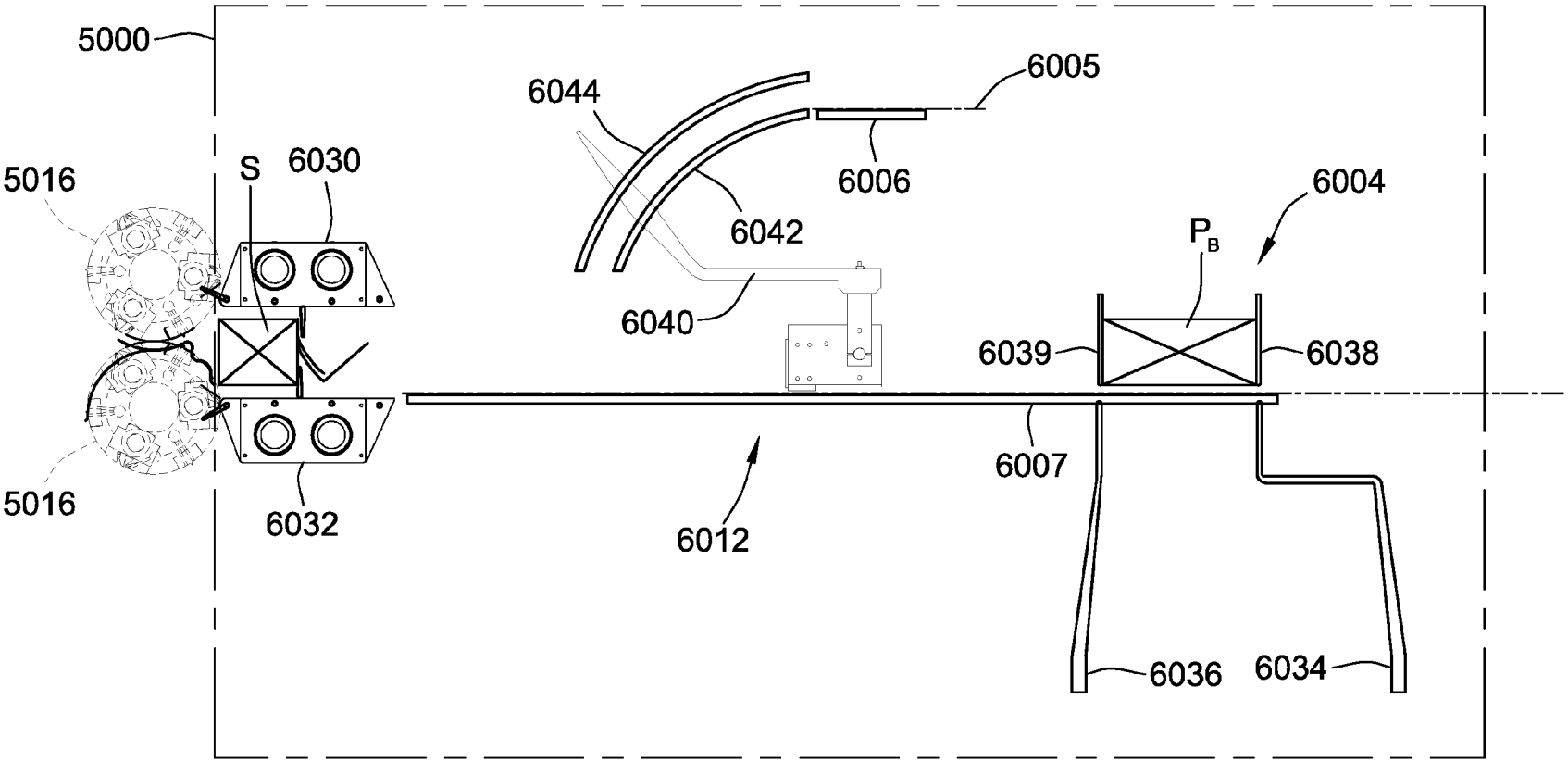

At the point during bulk pack operation shown in FIG. 12L, the first and second separator fingers 6034, 6036 have retracted below the common bed 6007, and transferred control of the downstream and upstream ends of the completed pack to the end gate 6038 and the paddle gate 6039. The next pack is continuing to build upstream from the upstream count fingers of the first and second count finger cassettes 6030, 6032.

Figure 12M:
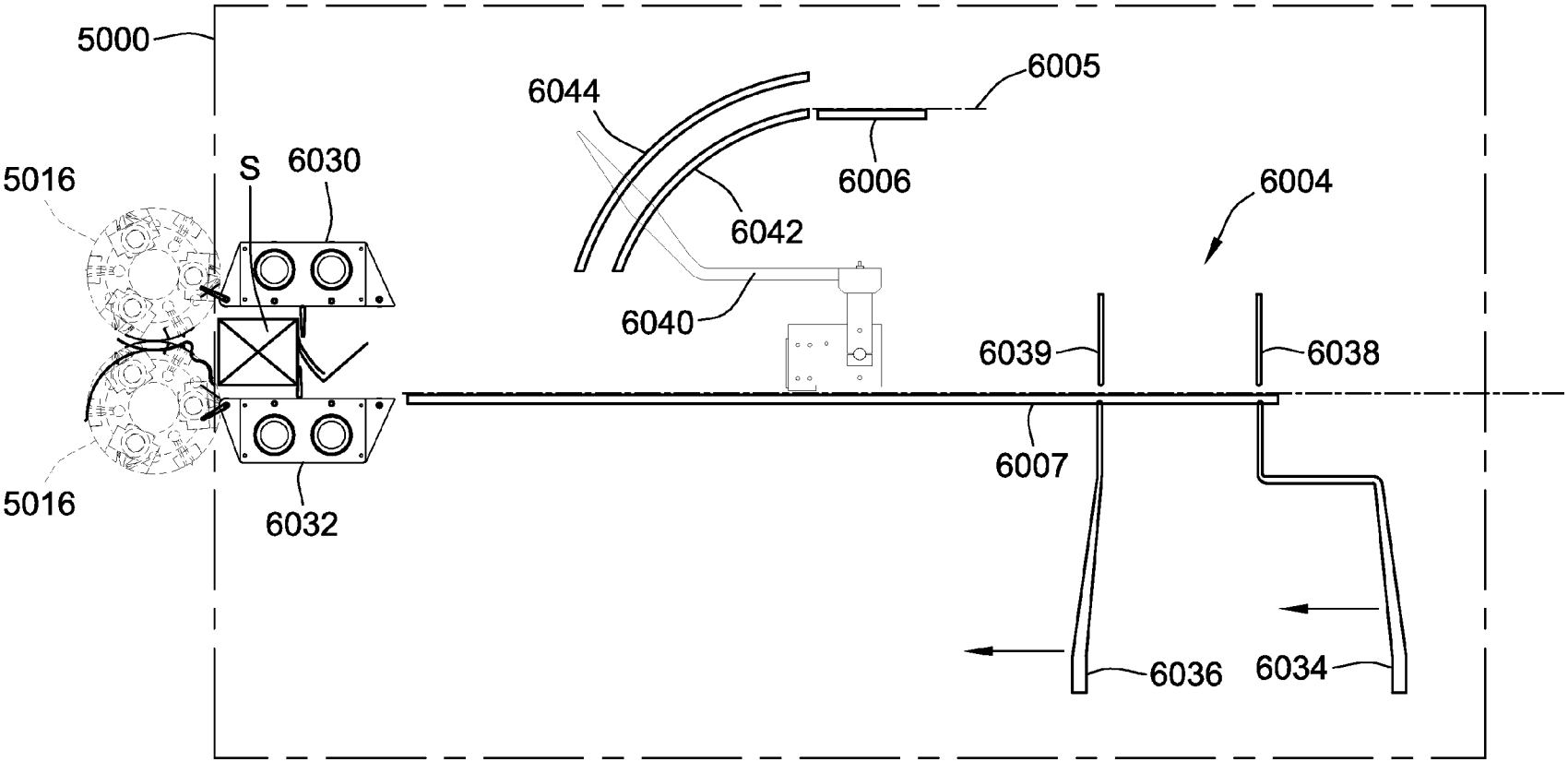
Figure 12N:
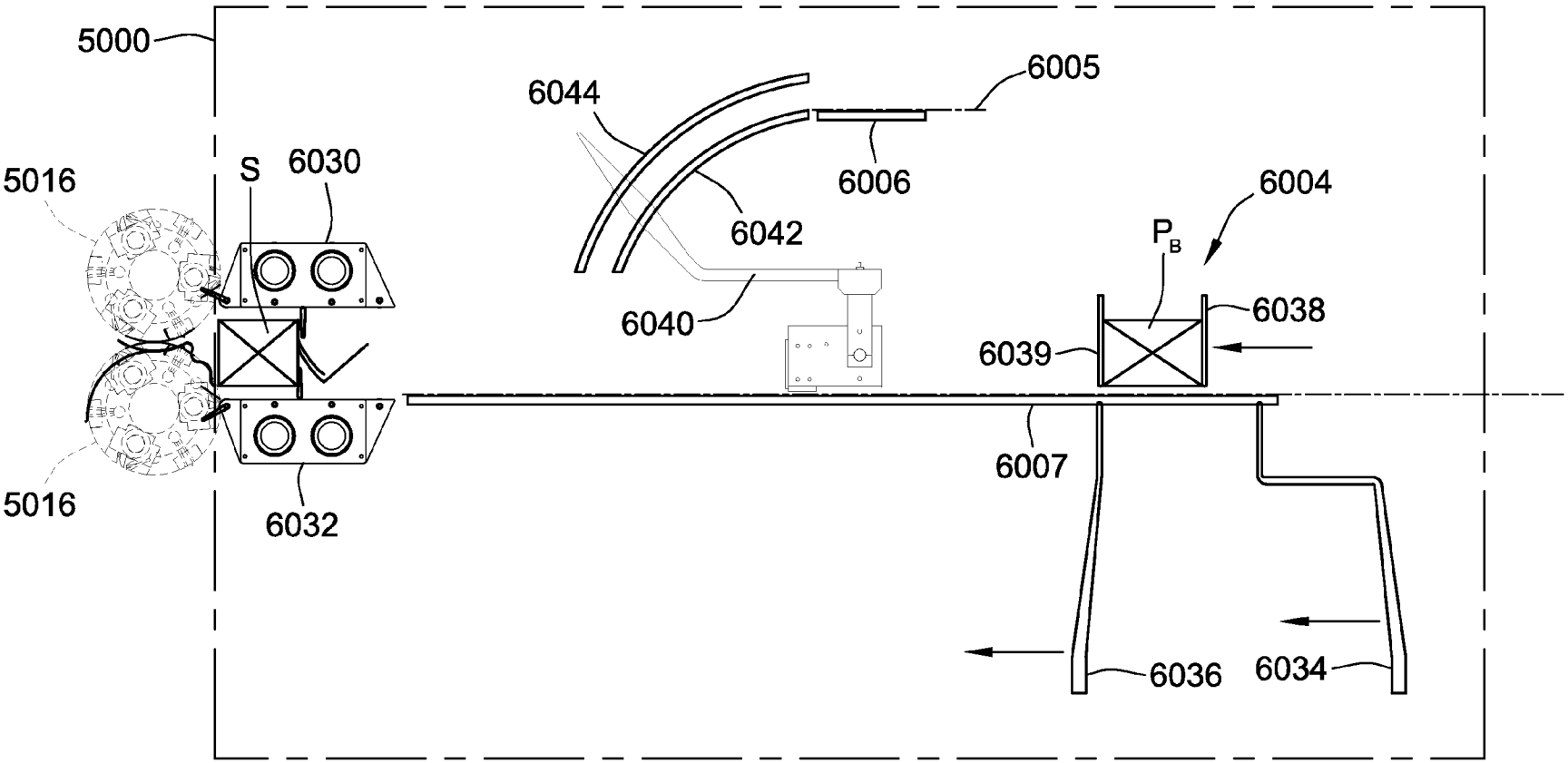

As shown in FIG. 12M, once the first and second separator fingers 6034, 6036 have retracted below the common bed 6007, they begin to move back toward the upstream end of the common bed 6007 to repeat their part of the separation and dispatching process for the next completed pack. As shown in FIG. 12M, the completed pack has been out of the bulk pack transfer station 6004, between the end gate 6038 and the paddle gate 6039, in a direction into or out of the plane of the drawing by a completed pack conveying arrangement (not shown).

As shown in FIG. 12N, in some embodiments of the invention the completed bulk pack may be compressed prior to being moved out of the bulk pack transfer station, by movement of the end gate toward the paddle gate as shown in FIG. 12N, or by other compressive operations involving one or both of the paddle and end gates 6039, 6038.

To complete the operational cycle in the bulk pack mode, the first and second separator fingers 6034, 6036 will move upstream to a point adjacent to the upstream end of the common bed 6007, and the first separator finger will move upward and into the stacking region to support the downstream end of the next pack, so that the downstream count fingers can be retracted and moved back to their ready position at the upstream end of the count finger cassettes 6030, 6032 to await insertion when the continually building stack S has added the desired number of sheets to the upstream end of the next pack. The separation process will then repeat itself for the next completed pack and each subsequent completed pack.

FIGS. 12O-12P illustrate an embodiment of the invention in which the first and second pack face guides 6042, 6044 are adjustable positionally with respect to one another to accommodate small packs of different heights. As shown in FIGS. 12Q-12T, the second pack face guide 6044 shown in FIG. 12P includes first and second telescopically connected sections thereof, and is connected at opposite ends of the second pack face guide 6044 in such a manner that the length and arc shape of the second pack face guide may be adjusted to better match the radial distance of the outer pack face guide from the face of the inner pack face guide.

FIGS. 13A-13D show another embodiment of a separator/dispatcher arrangement 7000, according to the invention, in which the pack turning arrangement 7012 includes a rotatable pack turner 7040 having an axis of rotation 7041 disposed between the pack inlet 7002 and the bulk pack transfer station 7004. The rotatable pack turner 7040 also has at least one pack receptacle therein including the pack direction surface and a face guide surface intersecting the pack directing surface. Specifically, in the embodiment shown in FIGS. 13A-13F, the rotatable pack turner 7040 defines four pack receptacles 7050 that are equally spaced apart. Each pack receptacle is a slot that faces generally radially outward relative to the axis of rotation 7041. In this embodiment, the slots, i.e. receptacles 7050, are not centered on the axis of rotation 7041. However, other embodiments, could be so configured. Each pack receptacle includes a respective pack directing surface 7052 and a face guide surface 7054 intersecting the pack directing surface 7052. The face guide surfaces 7054 are configured for contacting and supporting the downstream face $F_D$ of each small pack $P_S$ as the small pack $P_S$ is turned from resting on edge to resting on the downstream face $F_D$ of the small pack $P_S$ by rotation about the axis of rotation 7041 of the rotatable pack turner 7040.

As indicated sequentially in FIGS. 13A-13D, the small packs $P_S$ are separated from the continually building stack S with a separator arrangement, similar to the one described above with regard to FIGS. 12A-12I. First and second separator fingers 7034, 7036 support the downstream and upstream faces $F_D$, $F_U$ of the completed small pack $P_S$ as the completed small pack $P_S$ is transferred to the pack turning arrangement 7012.

Figure 13A:
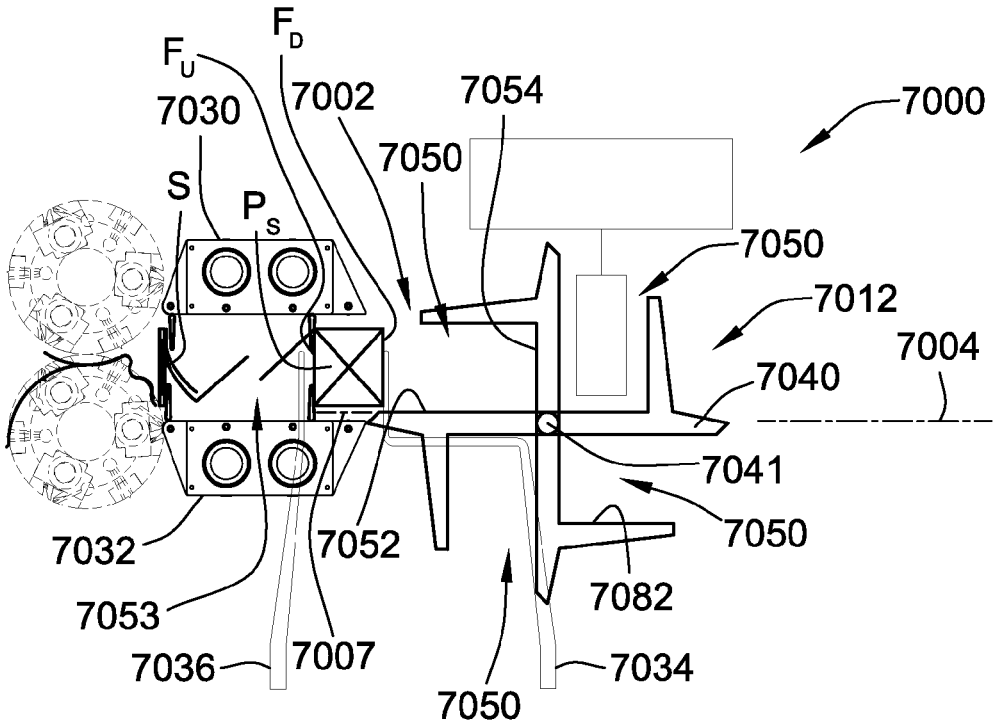
FIGS. 13A-13F are schematic illustrations of a second exemplary embodiment of a separator/dispatcher arrangement, according to the invention, illustrating construction details of a dispatcher arrangement having a rotatable pack turner, in both a small and a bulk pack mode of operation.
Figure 13B:
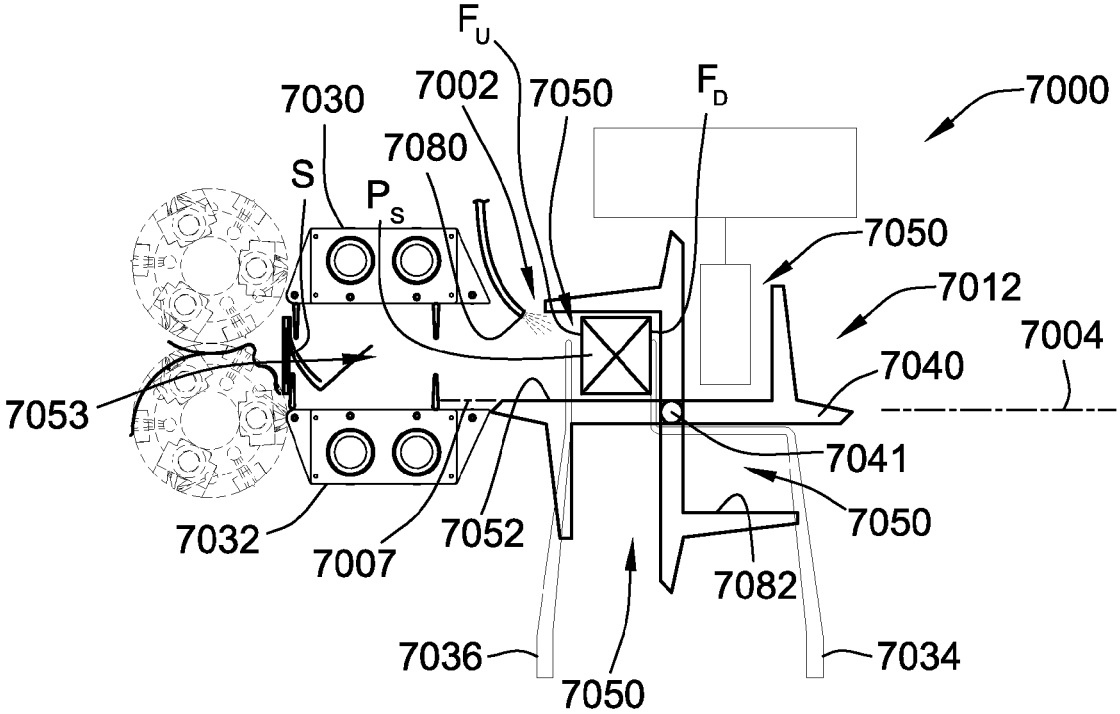

As shown in FIG. 13B, the pack directing surfaces 7052 of the pack turner 7040 are slotted to allow entry therein of the first and second separator finger 7034, 7036. To affect transfer of the completed small pack $P_S$ to one of the receptacles 7050 in the rotatable pack turner, the pack turner 7040 is positioned as shown in FIGS. 13A and 13B with one of the pack receptacles 7050 aligned with the stacking region 7053. Also, the pack directing surface 7052 of that receptacle is aligned with the common bed 7007. The first and second separator fingers 7034, 7036 then transport the completed small pack into the receptacle 7050, as shown in FIG. 13B.

Figure 13C:
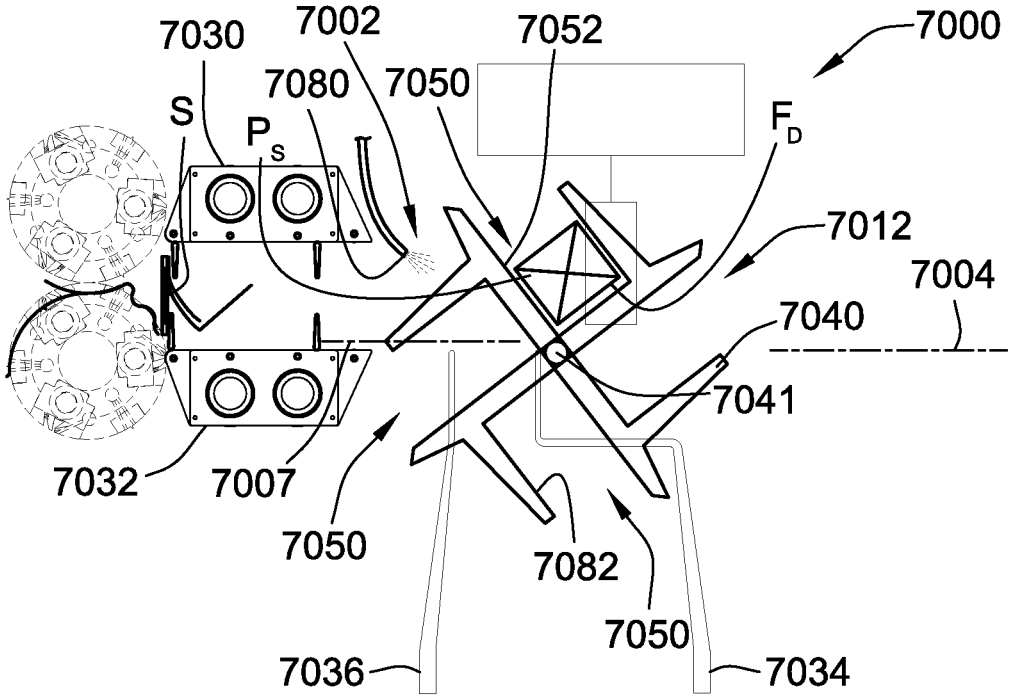

As shown in FIG. 13C, the first and second separator fingers 7034, 7036 are then retracted below the common bed 7007, and the rotatable pack turner 7040 is rotated about its axis 7041 (in a clockwise direction as shown in FIGS. 13A-13D). As the pack turner 7040 rotates, the pack directing surface 7052 of the receptacle 7050 in which the completed small pack $P_S$ is resting acts in much the same manner as the pack directing surface 6048 of the pivotal arm described above in relation to the embodiment of the invention shown in FIGS. 11A-11C and 12A-12N, to move the completed pack from the inlet 7002 to the small pack transfer station 7006. As the pack turner 7040 rotates, the orientation of the completed small pack $P_S$ is also changed from resting on the edges of the sheets within the small pack to an orientation with the completed small pack resting on the downstream face $F_D$ of the small pack.

Figure 13D:
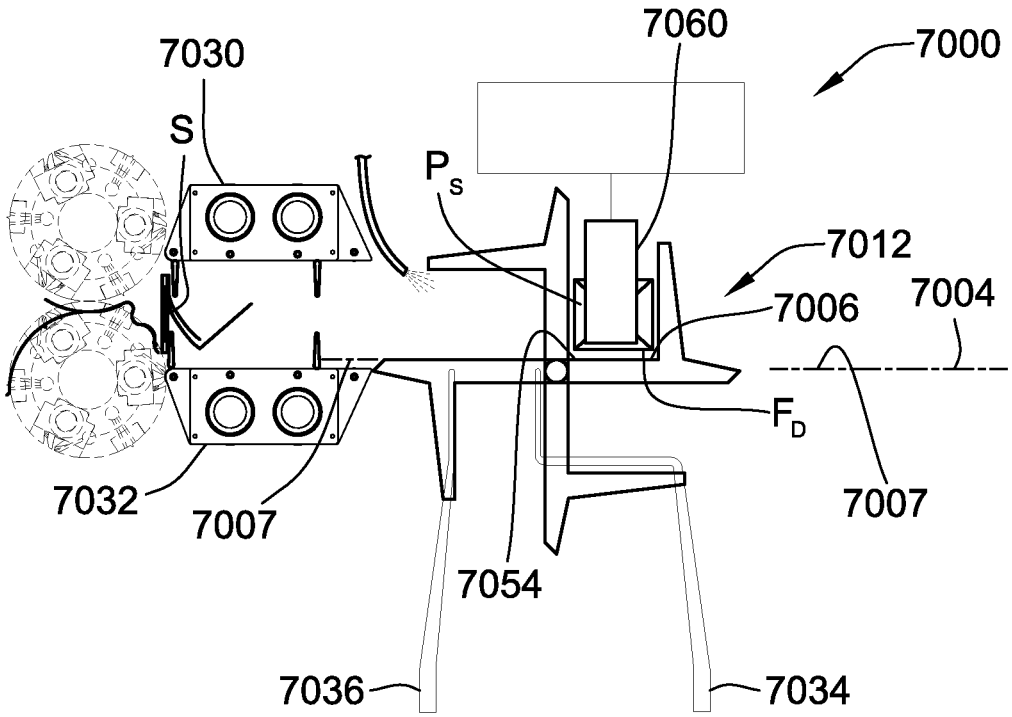

As shown in FIG. 13D, the rotatable pack turner 7040 rotates approximately 90° after receiving the completed small pack $P_S$, such that the face guide surface 7054 is brought into alignment with the common bed 7007 in such a manner that the face guide surface 7054 essentially establishes the surface of the small pack transfer station 7006 upon which the completed and rotated small pack $P_S$ is resting. Once the completed small pack Ps has been rotated in this manner, the completed small $P_S$ pack may be transferred out of the small pack transfer station 7006 by a movement into or out of the plane of the drawing, by a paddle conveyor 7060 or other appropriate apparatus or method.

Figure 13E:
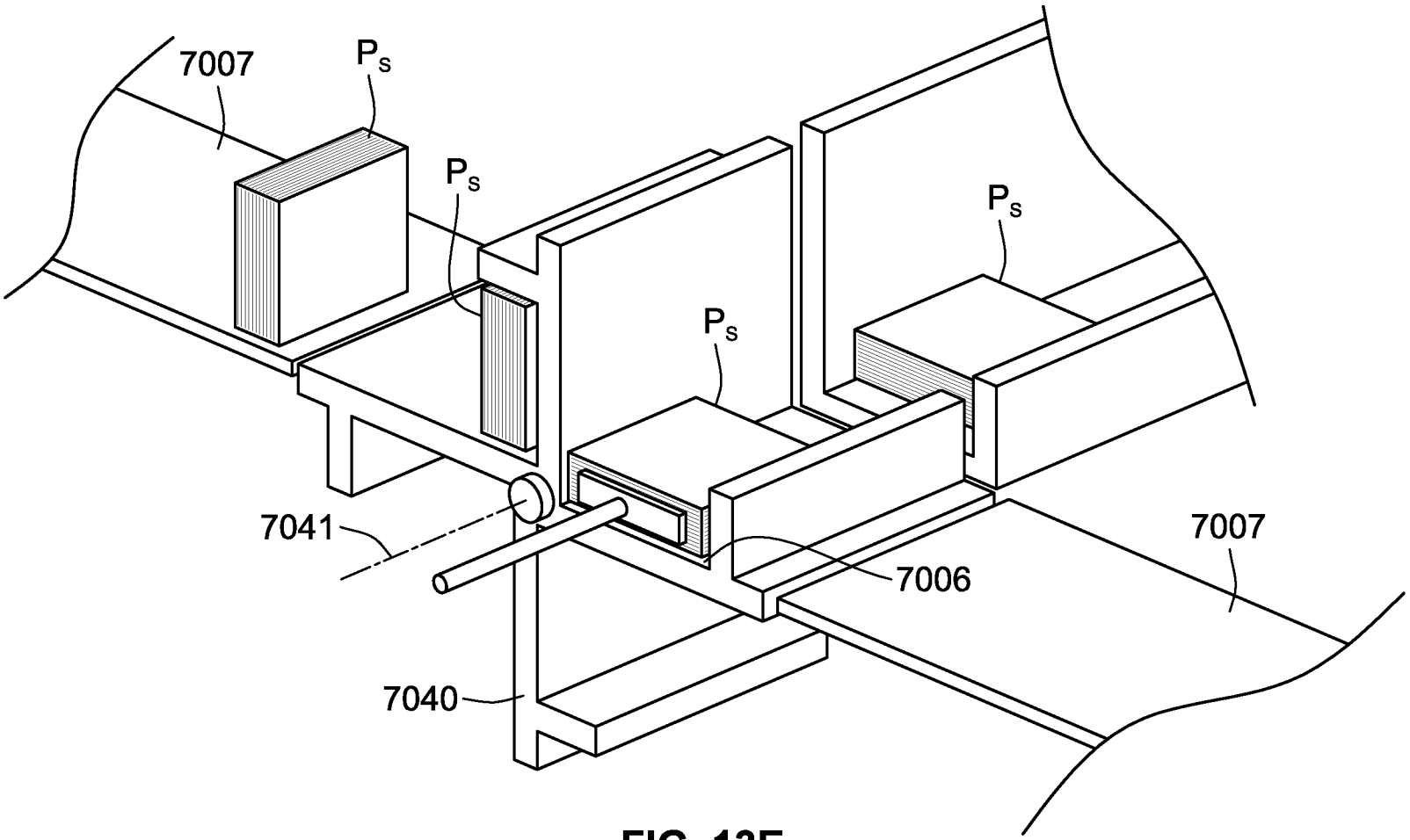

Those have skill in the art will recognize that the rotatable pack turner of FIGS. 13A-13D has the advantage of locating the small pack transfer station 7006 at substantially the same level as the common bed 7007, as illustrated in FIG. 13D and FIG. 13E. This arrangement may be more convenient in some embodiments of the invention than having the small pack transfer station oriented in a different plane from the inlet of a dispatching arrangement according to the invention. Having the small pack transfer station be in the same plane as the inlet, eliminates the need for having conveying arrangements disposed above the common bed of a separator/dispatcher arrangement of the type described above with reference to FIGS. 11A-11C and FIGS. 12A-12N.

Figure 13F:
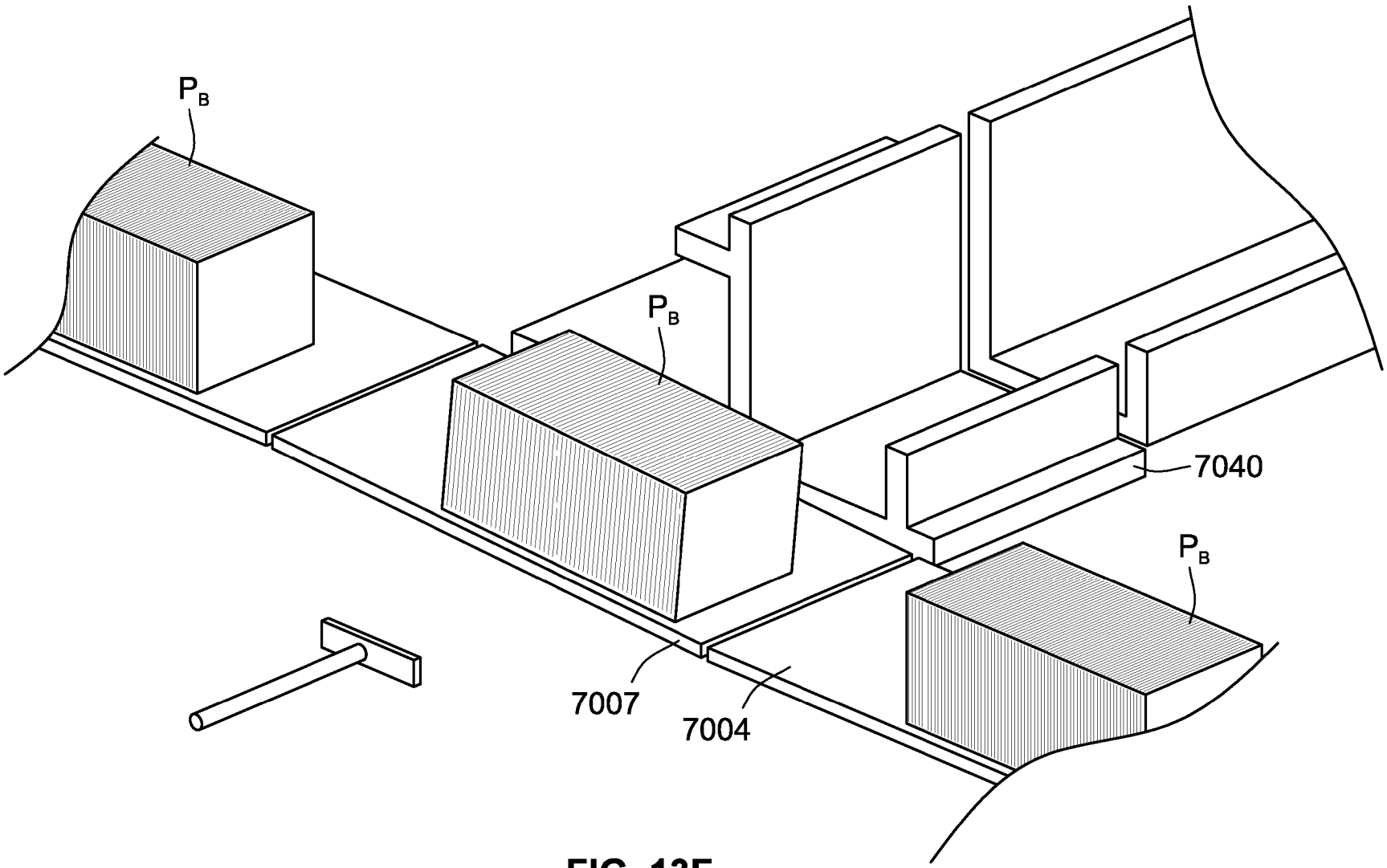

As shown in FIG. 13F, when an embodiment of the invention incorporating a rotatable pack turner of the type shown in FIGS. 13A-13D is operated in a bulk pack mode, the pack turner 7040 is either removed or shifted sideways or vertically in such a manner that the bulk packs $P_B$ can travel past the on the common bed 7007 where the pack turner 7040 is mounted for operation in the small pack mode, as the bulk packs are transferred by the first and second separator fingers 7034, 7036 (not shown in FIG. 13F) to the bulk pack transfer station 7004.

As illustrated in FIGS. 13B-13C, a pack turning arrangement, according to the invention may include a pack holding arrangement for retaining the completed small pack Ps within a receptacle of the pack turner during operation of the pack turner, after the first and second separator fingers have been retracted. For example, in the embodiment shown in FIGS. 13B and 13C, an air nozzle is operatively connected and configured for directing a jet of air 7080 against the upstream face $F_U$ of the completed small pack $P_S$ for urging the small pack $P_S$ into the receptacle 7050 in the rotatable pack turner 7040. As further illustrated in FIG. 13B, the embodiment of the rotatable pack turner 7040 shown in FIGS. 13A-13D also includes an opposite guide member 7082 extending from a distal end of the face guide surface 7054 and spaced from the pack directing surface 7052 for accommodating the small pack width and configured for contacting and supporting the opposite edges of the small packs $P_S$ as the small packs $P_S$ are turned from resting on an edge to resting on the downstream face $F_D$ of small pack $P_S$. It is further contemplated, that in various embodiments of pack turners according to the invention a pack holding arrangement may incorporate various mechanical or fluid actuated devices as appropriate, some of which will be described below in relation to other embodiments of the invention.

FIGS. 14A-14G show another exemplary embodiment of a separator/dispatcher arrangement 8000, according to the invention, wherein the pack turning arrangement 8012 includes an oscillating pack turner 8040 having an axis of rotation 8041 disposed between the inlet 8002, the bulk transfer station 8004 and the small pack transfer station 8006 of the pack dispatching arrangement 8012.

The oscillating pack turner 8040 has at least one pack receptacle 8050 therein. The pack receptacle 8050 includes a pack directing surface 8052 and a face guide surface 8054 intersecting the pack directing surface 8052 for contacting and supporting the downstream face $F_D$ of each small pack $P_S$ as the small packs $P_S$ are turned from resting on edge to resting on the downstream face $F_D$ of the pack by rotation about the axis of rotation 8041 of the oscillating pack turner 8040.

The oscillating pack turner 8040 is configured for receiving the completed small pack $P_S$ in a first angular position of the oscillating pack turner 8040 with respect to the inlet 8002 and the rotational axis 8041. The oscillating pack turner 8040 is shown in the first angular position thereof in FIGS. 14A and 14B. The oscillating pack turner 8040 delivers the small pack $P_S$ to the small pack transfer station 8006 in a second angular position of the oscillating pack turner 8040, with respect to the inlet 8002 and the rotational axis 8041. The oscillating pack turner 8040 is illustrated in the second angular position thereof in FIGS. 14D and 14E, and is shown transitioning between the first and second angular positions of the pack turner 8040 in FIG. 14C. As will be understood from the description below, the oscillating pack turner 8040 is configured for returning to the first angular position thereof after delivering the small pack $P_S$ to the small pack transfer station 8006.

The exemplary embodiment of the separator/dispatcher arrangement shown in FIGS. 14A-14G utilizes a separator arrangement having a pair of count finger cassettes and first and second separator fingers 8034, 8036 of a type substantially identical to the embodiments of the invention described herein above. Accordingly, the operation of separating the continually building stack into individual packs and delivery of the packs to pack turning arrangement 8012 in the small pack mode, and of the separator fingers 8034, 8036 transporting completed bulk packs past the pack turning arrangement 8012 in the bulk pack mode are not repeated in detail for this embodiment of the invention.

Figure 14A:
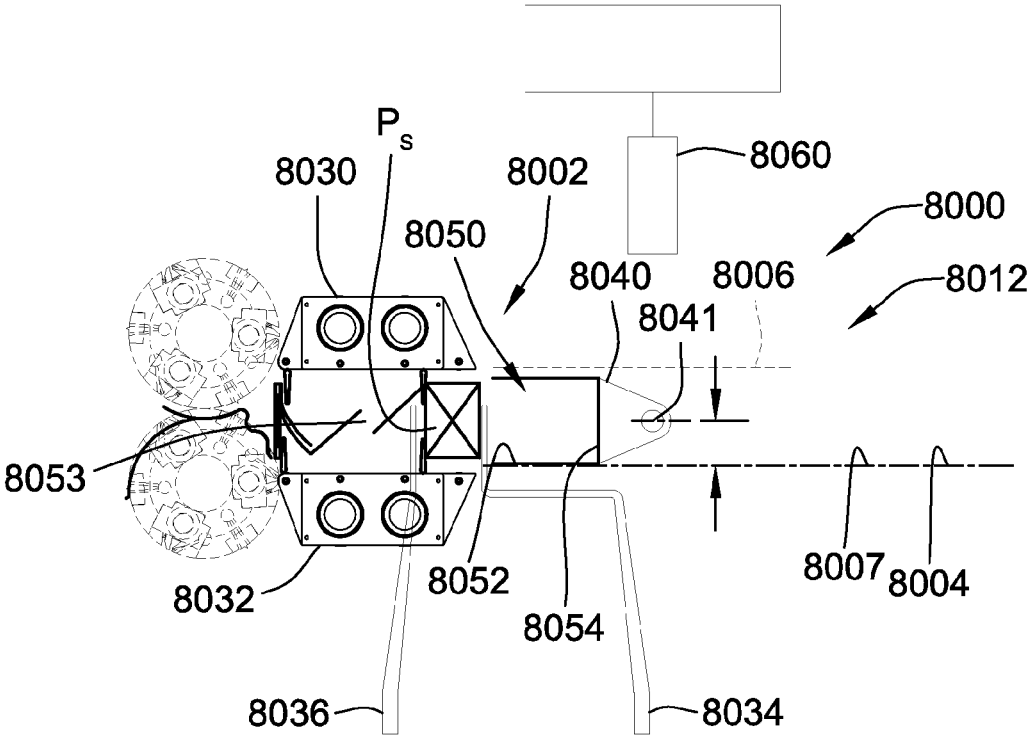
FIGS. 14A-14G illustrate a third exemplary embodiment of a separator/dispatcher arrangement, according to the invention, having a pack dispatching arrangement including an oscillating pack turner, with FIGS. 14A-14G illustrating construction and operation in both a small pack and a bulk pack operating mode.
Figure 14B:
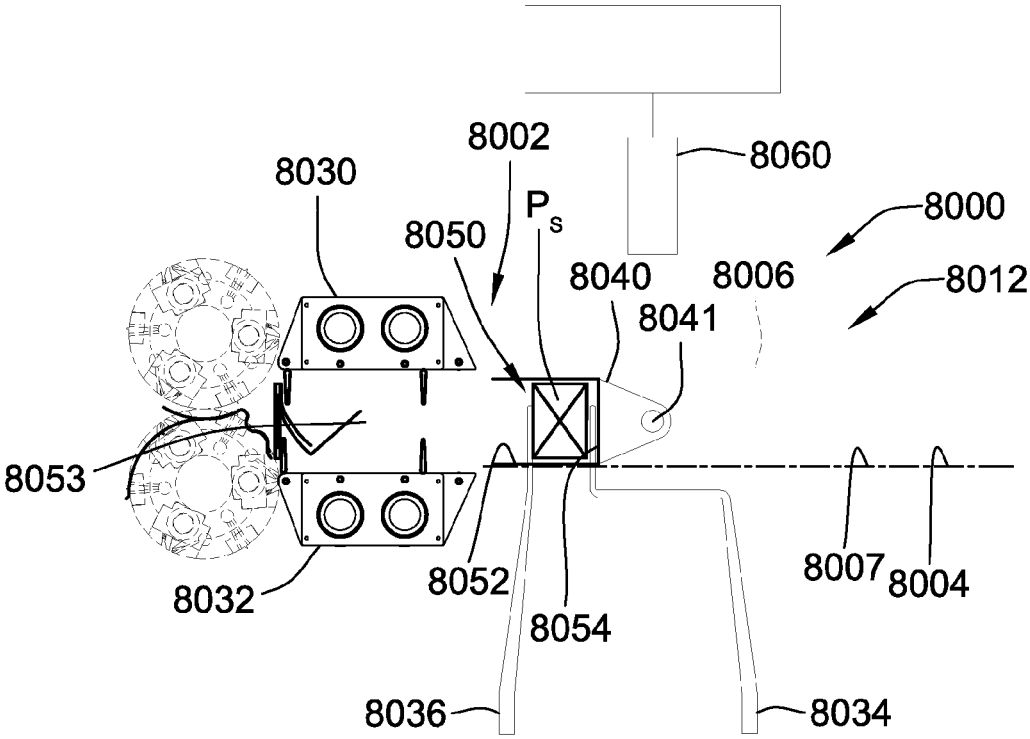

As will be understood from an examination of FIGS. 14A and 14B, when operating in the small pack mode, the oscillating pack turner 8040 is positioned in the first angular position illustrated in FIGS. 14A and 14B, with the receptacle 8050 substantially aligned with the stacking region 8053 between the first and second count finger cassettes 8030, 8032, so that the first and second separator fingers 8034, 8036 can transfer the completed small pack $P_S$ into the receptacle 8050. The oscillating pack turner 8040 is then rotated about its axis 8041, in the manner illustrated in FIG. 14C, from the first angular position of the oscillating pack tuner 8040 to the second angular position of the pack turner 8040 as shown in FIG. 14D. When positioned as shown in FIG. 14D, i.e., in the second angular position thereof, the face guide surface 8054 of the receptacle 8050 of the oscillating pack turner 8040 essentially becomes the small pack transfer station 8006. As indicated in FIG. 14D, the rotated small pack $P_S$ may then be moved out of the small pack transfer station by a paddle conveyor 8060 or other appropriate mechanism.

Figure 14C:
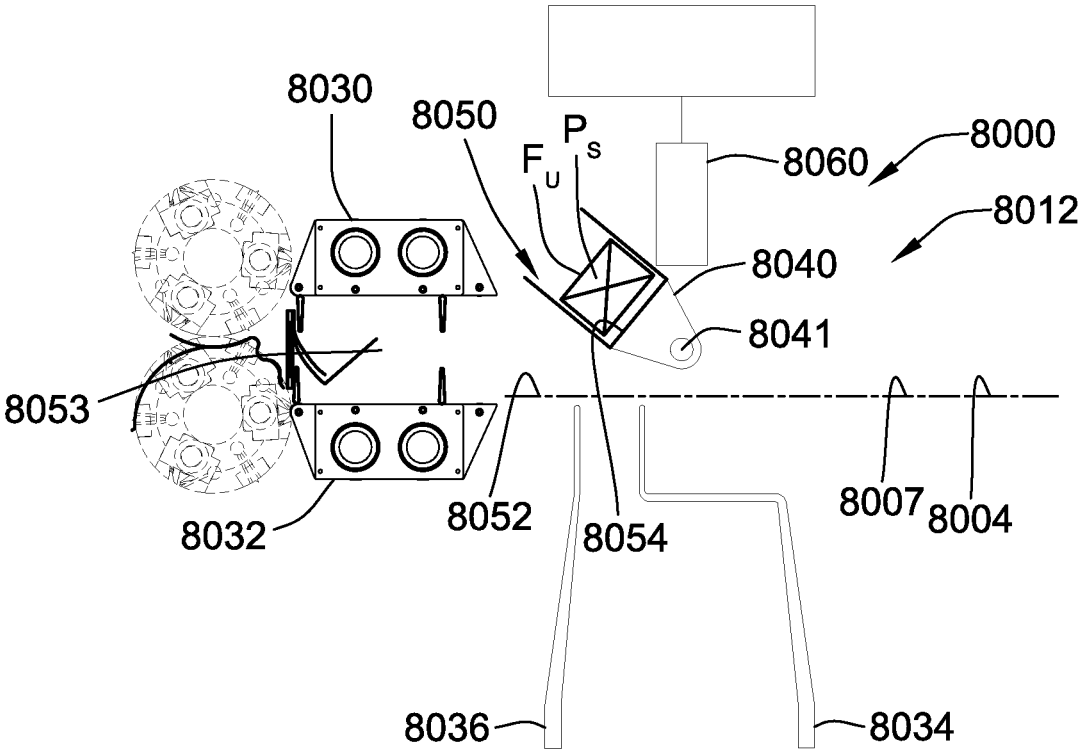
Figure 14D:
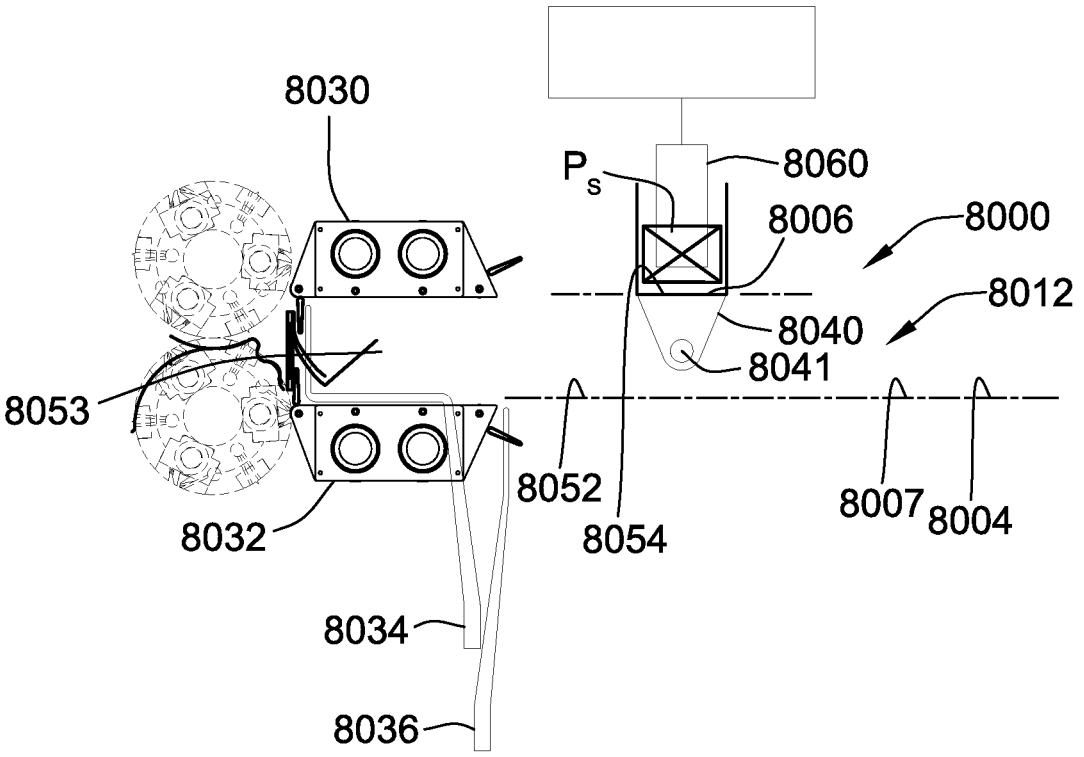
Figure 14E:
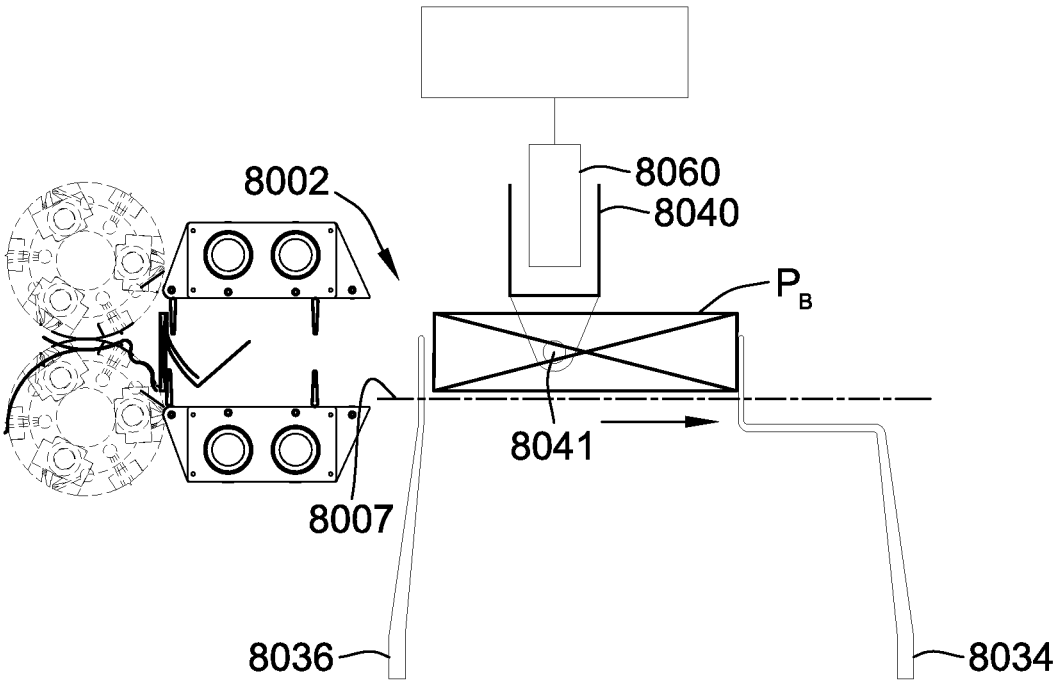
Figure 14F:
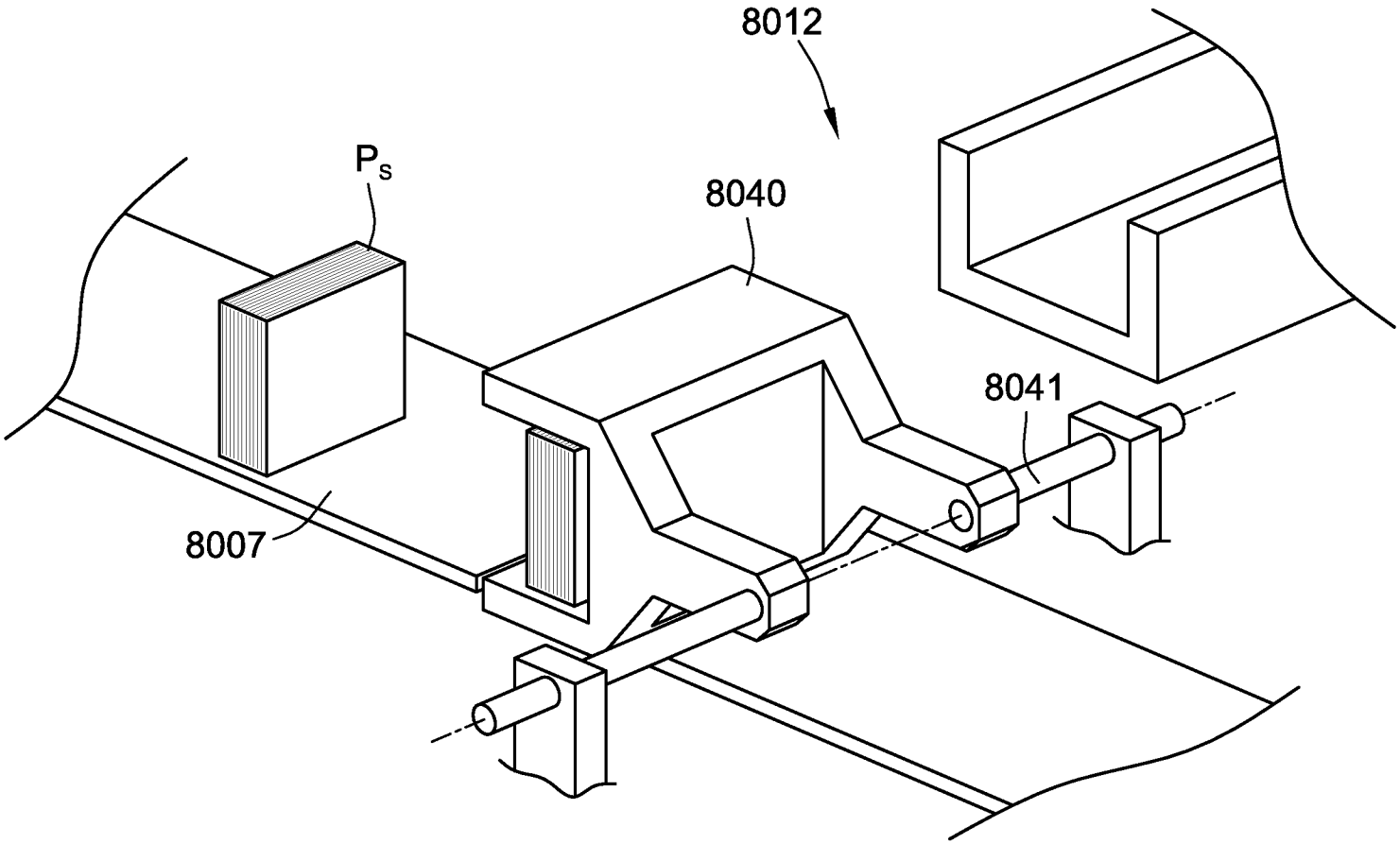
Figure 14G:
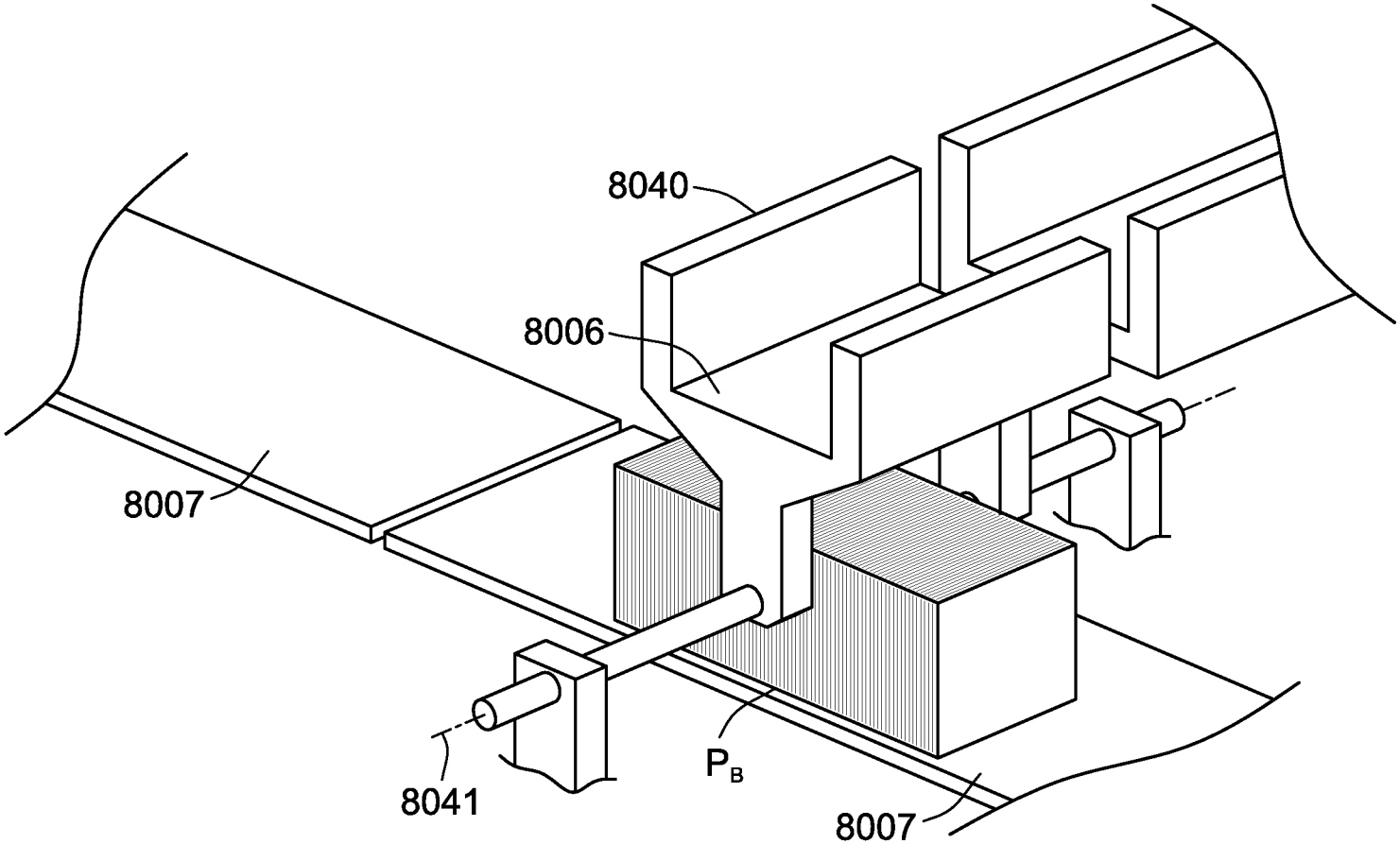

As illustrated in FIGS. 14E-14G, the oscillating pack turner 8040 is configured, and operatively connected through the rotational axis 8041 to the common bed 8007 with respect to the inlet 8002 in such a manner that, for operation in the bulk pack mode, the oscillating pack turner may be left in the second angular position thereof and the first and second separator fingers 8034, 8036 can transport the completed bulk packs $P_B$ through the pack turning station 8012 below the oscillating pack turner 8040.

As shown in FIG. 14C, the second separator finger 8036 may be left in a extended position as the oscillating pack turner 8040 is rotated from the first to the second angular positions thereof to provide support for the upstream face $F_U$ of the completed small pack $P_S$ during rotation of the oscillating pack turner 8040. As discussed in more detail below, an oscillating pack turner, according to the invention may also include pack holding arrangements, such as the air jet described above with regard to the embodiment shown in FIGS. 13B and C, or other types of mechanical or fluid actuated, active or passive, arrangements operatively connected to or mounted upon the oscillating pack turner to retain the completed pack within the receptacle during rotation of the oscillating pack turner 8040.

While not illustrated, a pack turning arrangement can handle two or more completed small packs. Pushers or paddle conveyors may be used to move the first and second small packs out of the pack turner to a small pack conveyor having regularly spaced paddles moving at a constant speed. In other embodiments of the invention, not shown, each lane in a multi-lane machine may have a separate pack turning arrangement, with the pack turners being controllable to deliver their respective small packs to the small pack transfer station at different times to match and achieve a smooth hand-off with the paddles of a paddle conveyor moving at constant speed with the paddles at fixed distances along the conveying arrangement.

While not illustrated, other embodiments of a separator/dispatcher arrangement, may utilize a pivotable arm pack dispatching arrangement having two parallel lanes for producing either small or bulk packs. The pivotable arm pack dispatching arrangement may include one pivotable arm for moving all packs from each lane or a dedicated pivotable arm for each lane. The pivotable arms and separator fingers may be moveable at different speeds so that the completed small packs may be delivered to a small pack conveyor having regularly spaced paddles moving at a constant speed, without having interference between the small packs as they are delivered to the paddles of the paddle conveyor.

Pack turning arrangements may include pack holding arrangements for retaining small packs within the pack turning arrangement as the pack turning arrangement transfers the small packs from an inlet of the dispatcher to the small pack transfer station. Pack holders, other than the air blasts discussed above, incorporating fluid actuators, gravity driven pack holders, and spring loaded pack holders are all contemplated. The pack holders operably clamp or otherwise bias or urge the upstream face $F_U$ of the small pack $P_S$ during rotation of the rotating pack turning arrangements.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A separator apparatus for separating a stack of folded sheets into either small or bulk packs of the folded sheets, the apparatus comprising:

a separator arrangement for separating the stack of folded sheets into a stream of spaced apart packs of folded sheets, the separator arrangement being alternatively operable in a small-pack mode in which the separator forms small packs of folded sheets and a bulk-pack mode in which the separator forms bulk packs of folded sheets;

a pack dispatching arrangement having an inlet for receiving each pack from the separator arrangement, a bulk pack transfer station, and a small pack transfer station;

the pack dispatching arrangement being operable in a bulk pack mode for delivering a bulk pack received at the inlet to the bulk pack transfer station;

the pack dispatching arrangement being alternatively operable in a small pack mode for delivering a small pack received at the inlet to the small pack transfer station; and wherein:

the folded sheets in the separated packs are oriented on an edge of the folded sheets with the packs each having an upstream and a downstream face thereof oriented substantially perpendicular to the edge of the folded sheets as the packs enter the pack dispatching arrangement;

the bulk pack received at the inlet is delivered to the bulk pack transfer station with the sheets in the bulk pack resting on the edges of the folded sheets when in the bulk-pack mode; and the small pack received at the inlet is delivered to the small pack transfer station with the small pack resting on one of the faces of the small pack when operating in the small-pack mode.

2. The apparatus of claim 1, wherein, the pack dispatching arrangement further comprises a pack turning arrangement having a pack directing surface for contacting the edges of the sheets in each small pack, during operation of the pack dispatching arrangement in the small pack mode, and the pack turning arrangement urging the small pack to turn from the orientation as received at the inlet with the sheets in the small pack oriented on the edges of the sheets toward the orientation with the small pack resting on one of the faces of the small pack.

3. The apparatus of claim 2, wherein, the pack turning arrangement comprises:

a pivotable arm having a proximal end pivotably fixed with respect to the inlet of the pack dispatching arrangement, and including the pack directing surface; and at least one pack face guide member disposed adjacent the pivotable arm for contacting and supporting the one of the faces of the small pack as the small pack is turned from resting on edge to resting on the one of the faces of the small pack.

4. The apparatus of claim 3, wherein, the small pack defines a length thereof between the upstream and downstream faces of the small pack, and the pack turning arrangement further comprises, upstream and downstream face guide members spaced from one another in a parallel manner at a guide width for accommodating the small pack length and configured for contacting and supporting both the upstream and downstream faces of the small pack as the small pack is turned from resting on edge to resting on the one of the faces of the small pack.

5. The apparatus of claim 2, wherein, the pack turning arrangement comprises:

a rotatable pack turner having an axis of rotation, the rotatable pack turner being disposed between the inlet, the bulk pack transfer station and the small pack transfer station of the pack dispatching arrangement;

the rotatable pack turner also having at least one pack receptacle therein including the pack directing surface and a face guide surface intersecting the pack directing surface for supporting the downstream face of the small pack as the small pack is turned from resting on edge to resting on the downstream face of the small pack by rotation about the axis of rotation of the rotatable pack turner.

6. The apparatus of claim 5, wherein, the small pack defines a width thereof between the edge of the small pack resting on the pack directing surface of the rotatable pack turner and an opposite edge of the small pack spaced away from the pack directing surface, and the rotatable pack turner further comprises, an opposite edge guide member extending from a distal end of the face guide surface and spaced from the pack directing surface for accommodating the small pack width and configured for supporting the opposite edges of the small pack as the small pack is turned from resting on edge to resting on the downstream face of the small pack.

7. The apparatus of claim 6, further comprising an air nozzle operatively connected and configured for directing a jet of air against the upstream face of the small pack to prevent upstream sheets of the small pack from lifting off of the small pack while rotating from the inlet to the small pack transfer station.

8. The apparatus of claim 5, wherein:

the separator arrangement includes an upstream finger and a downstream finger configured for respectively supporting the upstream and downstream faces of the small pack as it moves into the inlet of the pack dispatching arrangement;

the separator fingers being operatively connected for retracting after the small pack is moved into the receptacle in the rotatable pack turner.

9. The apparatus of claim 5, wherein:

the rotatable pack turner included at least two receptacles therein for receiving successive small packs from the separator fingers;

the rotatable pack turner is configured for receiving the small pack when the receptacles are respectively disposed in a first angular position thereof with respect to the inlet and the rotational axis of the rotatable pack turner and delivers the small packs to the small pack transfer station when the receptacles are respectively disposed in a second angular position of the rotatable pack turner with respect to the inlet and the rotational axis; and the rotatable pack turner is also configured for successively returning the receptacles to the first angular position thereof after delivering the small pack to the small pack transfer station for receiving a next small pack.

10. The apparatus of claim 5, wherein, the rotatable pack turner is generally a wheel that includes four equally spaced receptacles, each slot being a slot that faces radially outward relative to the axis of rotation.

11. The apparatus of claim 10, wherein the slots are offset from the axis of rotation of the rotatable pack turner.

12. The apparatus of claim 8, wherein, when operating in the bulk pack mode, the rotatable pack turner is configured for positioning such that the separator fingers transport the bulk pack past the rotatable pack turner to the bulk pack transfer station; and further comprising, a back stop and a paddle gate operatively disposed downstream and upstream of the bulk pack transfer station for receiving the bulk pack from the separator fingers; and wherein, the separator fingers retract after transferring the bulk pack to the back stop and paddle gate and return to receive another bulk pack from the stack.

13. The apparatus of claim 1, wherein:

the bulk pack exits the bulk pack transfer station along a bulk pack path that is different than a small pack path along which the small pack exits the small pack transfer station.

14. The apparatus of claim 5, wherein, the rotatable pack turner rotates in only one direction about its axis of rotation.

15. The apparatus of claim 5, wherein, the rotatable pack turner is an oscillating pack turner, the oscillating pack turner rotates in a first direction about the axis of rotation as the rotatable pack turner travels from the inlet to the small pack transfer station and pivots in an opposite second direction about the axis of rotation as the rotatable pack turner travels from the small pack transfer station to the inlet, a degree of rotation between the inlet and the small pack transfer station being less than a full rotation.

16. A separator apparatus for separating a stack of folded sheets into either small or bulk packs of the folded sheets, the apparatus comprising:

a separator arrangement for separating the stack of folded sheets into a stream of spaced apart packs of folded sheets, the separator arrangement being alternatively operable in a small-pack mode in which the separator forms small packs of folded sheets and a bulk-pack mode in which the separator forms bulk packs of folded sheets;

a pack dispatching arrangement having an inlet for receiving each pack from the separator arrangement, a bulk pack transfer station, and a small pack transfer station;

the pack dispatching arrangement being operable in a bulk pack mode for delivering a bulk pack received at the inlet to the bulk pack transfer station;

the pack dispatching arrangement being alternatively operable in a small pack mode for delivering a small pack received at the inlet to the small pack transfer station;

wherein, the stack of folded sheets is comprised of a plurality of folded sheets moving in a stacking direction, the plurality of folded sheets having panels thereof extending substantially perpendicular to the stacking direction and joined by folds aligned with the folds of adjacent sheets to define a side of the stack of folded sheets, the apparatus further comprising:

a bed surface having an inlet portion and an outlet portion at opposite ends thereof and extending in the stacking direction from the inlet portion to the outlet portion thereof with the inlet portion being adjacent the inlet of the pack dispatching arrangement and with the outlet being adjacent to the bulk pack transfer station, the bed surface being configured for receiving and supporting the stream of folded sheets on the side of stacked sheets and directing the stream of folded stacked sheets along the bed surface in the stacking direction from the inlet portion of the bed surface toward the bulk pack transfer station;

wherein the small pack transfer station is laterally spaced from the bed surface;

wherein the separator arrangement separates the stack of folded sheets on the bed surface into a stream of bulk packs in the bulk-pack mode and small packs in the small-pack mode, the packs having folded sheets therein defining a portion of the side of the stack of folded sheets, with the separated packs being spaced from adjacent packs in the stacking direction and supported on the side of each pack of stacked folded sheets;

the pack dispatching arrangement being operable in the bulk pack mode for allowing bulk packs to proceed along the bed surface to the bulk pack transfer station; and the pack dispatching arrangement being alternatively operable in the small pack mode for intercepting the small packs upstream from the bulk transfer station and directing the small packs off of the bed surface to the small pack transfer station.

17. The separator apparatus of claim 16, wherein, the pack dispatching arrangement receives the bulk and small packs of substantially vertically oriented folded sheets from the separator arrangement and supports the packs of sheets in a vertical orientation of the sheets and directs the packs toward the bulk pack transfer station;

the pack dispatching arrangement further including a pack turning arrangement for intercepting small packs upstream of the bulk pack transfer station, and transports the small packs to the small pack transfer station before the small packs reach the bulk pack transfer station; and the small pack transfer station is configured for receiving the small packs with the sheets therein oriented at an angle other than vertical; and the pack turning arrangement configured for turning the small packs from the vertical orientation to the angle other than vertical.

18. A pack dispatching arrangement for alternatively dispatching a stream of spaced apart small packs or a stream of bulk packs of folded sheets separated from a stack of folded sheets by a single separator arrangement, the pack dispatching arrangement comprising:

an inlet for receiving each pack from the separator arrangement;

a bulk pack transfer station; and a small pack transfer station;

the pack dispatching arrangement being operable in a bulk pack mode for delivering a bulk pack received at the inlet to the bulk pack transfer station; and the pack dispatching arrangement being alternatively operable in a small pack mode for delivering a small pack received at the inlet to the small pack transfer station;

wherein:

the folded sheets in the separated packs are oriented on an edge of the folded sheets with the packs each having an upstream and a downstream face thereof oriented substantially perpendicular to the edge of the folded sheets as the packs enter the pack dispatching arrangement;

the bulk pack received at the inlet is delivered to the bulk pack transfer station with the sheets in the bulk pack resting on the edges of the folded sheets when in the bulk pack mode; and the small pack received at the inlet is delivered to the small pack transfer station with the small pack resting on one of the faces of the small pack when operating in the small pack mode.

* * * * *